US009776760B2

(12) United States Patent
Keeder

(10) Patent No.: US 9,776,760 B2
(45) Date of Patent: Oct. 3, 2017

(54) DISPLAY-READY RETAIL CASE WITH DIVIDE

(71) Applicant: Kellogg Company, Battle Creek, MI (US)

(72) Inventor: Karen Keeder, Kalamazoo, MI (US)

(73) Assignee: Kellogg Company, Battle Creek, MI (US)

( * ) Notice: Subject to any disclaimer, the term of this patent is extended or adjusted under 35 U.S.C. 154(b) by 0 days.

(21) Appl. No.: 15/151,038

(22) Filed: May 10, 2016

(65) Prior Publication Data

US 2016/0332769 A1 Nov. 17, 2016

Related U.S. Application Data

(60) Provisional application No. 62/159,604, filed on May 11, 2015.

(51) Int. Cl.
*B65D 5/48* (2006.01)
*B65D 5/498* (2006.01)
(Continued)

(52) U.S. Cl.
CPC ..... *B65D 5/48048* (2013.01); *B31B 1/90* (2013.01); *B65D 5/20* (2013.01); *B65D 5/328* (2013.01);
(Continued)

(58) Field of Classification Search
CPC ..... B65D 5/0218; B65D 5/20; B65D 5/32; B65D 5/321; B65D 5/323; B65D 5/328; B65D 5/54; B65D 5/541; B65D 5/5445; B65D 5/64; B65D 5/48048; B31B 31/90; B31B 2201/9009
(Continued)

(56) References Cited

U.S. PATENT DOCUMENTS 1,808,922 A * 6/1931 Gallistel ..... B65D 5/48018 229/120.18
3,347,356 A 10/1967 Kossnar
(Continued)

OTHER PUBLICATIONS

PCT/US2016/031641 International Search Report dated Jul. 1, 2016.

*Primary Examiner* — Chun Cheung
*Assistant Examiner* — Brijesh V. Patel
(74) *Attorney, Agent, or Firm* — Honigman Miller Schwartz and Cohn LLP; Kathryn D. Doyle, Esq.; Jonathan P. O'Brien

(57) ABSTRACT

The disclosed retail case includes a base member and an upper member selectively attached to the base member. The base member has a bottom wall and at least two base walls extending from the bottom wall. The base walls have an outer surface and an inner surface. The upper member has a top wall and at least two upper walls extending from the top wall. The upper walls have an outer surface and an inner surface. The outer surface of the upper walls attaches to the inner surface of the respective base walls at an attachment portion of the upper walls that is selectively removable from the upper walls to allow the attachment portion to remain attached to the base member when the upper member is removed from the base member. The attachment portion may also associate with flap portions that are connected to form a divider.

20 Claims, 15 Drawing Sheets

(51) Int. Cl.

| | |
|---|---|
| ***B65D 5/32*** | (2006.01) |
| ***B65D 5/54*** | (2006.01) |
| ***B31B 1/90*** | (2006.01) |
| ***B65D 5/20*** | (2006.01) |
| ***B65D 5/64*** | (2006.01) |

(52) U.S. Cl.
CPC ..... *B65D 5/54* (2013.01); *B65D 5/64* (2013.01); *B31B 2201/9009* (2013.01)

(58) Field of Classification Search
USPC .... 206/736, 746–747, 773–775; 229/120.06, 229/120.14, 120.18, 120.24–120.25, 229/120.31, 120.38, 129, 235, 240–241; 220/666
See application file for complete search history.

(56) References Cited

U.S. PATENT DOCUMENTS 3,348,667 A * 10/1967 Beeby ..... B65D 5/4804 206/770
3,653,495 A * 4/1972 Gray ..... B65D 5/5253 206/746
3,980,223 A 9/1976 Curran
4,058,206 A * 11/1977 Morse ..... B65D 5/542 229/120.02
4,114,796 A 9/1978 Voges
4,197,979 A * 4/1980 Dutcher ..... B65D 5/48004 229/117.18
4,213,559 A 7/1980 Meyers
4,376,508 A * 3/1983 Gardner ..... B65D 5/48008 229/120.17
4,396,146 A * 8/1983 Sieffert ..... B65D 5/48018 229/117.06
4,403,727 A 9/1983 Grieve et al.
4,541,560 A * 9/1985 Fischer ..... B65D 5/48004 229/120.18
5,520,325 A * 5/1996 Quaintance ..... B65D 5/48026 229/120.26
5,722,584 A * 3/1998 Fujiwara ..... B65D 5/5445 229/120.15
6,168,027 B1 1/2001 Esser
6,270,007 B1 * 8/2001 Jensen, Jr. ..... B65D 5/32 229/120
7,066,379 B2 * 6/2006 McLeod ..... B65D 5/321 229/120.24
7,451,878 B2 * 11/2008 Rochefort ..... B65D 5/48024 206/738
7,455,215 B2 * 11/2008 McLeod ..... B65D 5/321 229/120.24
2007/0221715 A1 9/2007 Tibbels et al.
2011/0215137 A1 9/2011 Snyder
2011/0290796 A1 * 12/2011 Burgess ..... B65D 21/04 220/23.2
2012/0160735 A1 6/2012 Waidelich
2013/0199965 A1 * 8/2013 Tibbels ..... B65D 5/52 206/774

* cited by examiner

DISPLAY-READY RETAIL CASE WITH DIVIDE

CROSS REFERENCE TO RELATED APPLICATION

This application claims the benefit of U.S. Provisional application No. 62/159,604, filed on May 11, 2015. The entire contents of the aforementioned application are hereby incorporated by reference in their entirety.

TECHNICAL FIELD

This disclosure relates to retail cases utilized to ship, display, and dispense products.

BACKGROUND

Retail cases may be utilized for shipping and storing products prior to the products being displayed in a retail setting. For example, product producers, shippers, and product retailers often utilize regular slotted containers (RSCs) as retail cases, as such cases are capable of supporting and protecting product during shipment and storage. RSCs generally have an upper wall, a bottom wall, and four side walls that connect the upper wall to the bottom wall. The upper wall and the bottom wall are both typically formed by four flaps that close to form the upper wall and the bottom wall. This construction minimizes the necessary material for construction and, as a result, reduces the costs associated with producing the RSC.

The size and shape of retail cases vary to accommodate the particular characteristics of the product being shipped and to accommodate other environmental conditions. With both floor space and storage volume often at a premium, retail case manufacturers, product producers, and product retailers often require retail cases that maximize product storage in limited floor space and storage volume.

Increasingly, product retailers prefer to display the product within the retail case in an effort to minimize operational costs associated with unpacking, displaying the product, and discarding the retail case. Traditional retail cases, while adequate for shipping and storing products, are ill-suited for displaying the product within. For example, conventional retail cases are typically bulky and do not include graphics that identify or otherwise advertise the product contained therein. Further, such retail cases—to the extent they can fit on retail shelving—do not provide for the retail case to be easily opened or positioned in more than one orientation. As such, conventional retail cases are typically only useful for their intended purpose—shipping and storage of product before the product is put on display in a retail setting.

SUMMARY

This disclosure presents a display-ready polyjoiner retail case of an RSC style including a divide to support a product after the case has been shopped down. The retail case of this disclosure improves the quality of display-ready capabilities when the case is shopped down. This disclosure also presents a process of manufacturing and forming a display-ready, RSC-style, polyjoiner retail case.

One aspect of the disclosure provides a retail case including a base member and an upper member. The base member has a bottom wall and at least two base walls extending from the bottom wall. The at least two base walls have a first surface and a second surface. The first surface defines an outer surface of the base member. The second surface cooperates with the bottom wall to define an inner surface of the base member. The upper member is selectively attached to the base member and has a top wall and at least two upper walls extending from the top wall. The at least to upper walls have a first surface and a second surface. The first surface defines an outer surface of the upper member. The second surface cooperates with the top wall to define an inner surface of the upper member. The upper walls are attached, at their first surface, to the second surface of the base walls at an attachment portion of the upper walls. The attachment portion of the upper walls is selectively removable from the upper walls to allow the attachment portion to remain attached to the base member when the upper member is removed from the base member.

Implementations of the disclosure may include one or more of the following optional features. In some implementations, the attachment portion associates with a flap portion that is movable relative to the base member when the upper member is removed from the base member. In some examples, the attachment portion includes two distinct attachment portions. The flap portions are attached to one another to connect the upper walls to one another within the base member. The flap portions may be attached to one another regardless of whether the upper member is attached to the base member. Additionally, the flap portions may extend across a width of the base member and in a direction substantially perpendicular to a longitudinal axis of the base member.

In some implementations, the flap portions may be formed from the upper walls and may have a shape defined by predetermined areas of weakness. The predetermined areas of weakness may be defined by perforations formed in the upper walls. The attachment portions may be separated from the upper walls along the perforations when the upper member is removed from the base member.

In some implementations, the at least two base walls include four base walls and the at least two upper walls include four base walls. A first attachment portion and a second attachment portion are formed from opposing upper walls. Additionally, a central hole may be formed within the upper walls relative to the attachment portion. Finally, an access hole may be formed within the base walls, and a central flap may be formed from the upper walls. The central flap, which moves relative the upper walls, opens and closes the access hole.

Another aspect of the disclosure provides a retail case including a base member and an upper member. The base member has a bottom wall and at least two base walls extending from the bottom wall. The at least two base walls have a first surface and a second surface. The first surface defines an outer surface of the base member. The outer surface of the base member may include graphics that identify or otherwise advertise the product contained therein. The second surface cooperates with the bottom wall to define an inner surface of the base member. The upper member is selectively attached to the base member and has a top wall and at least two upper walls extending from the top wall. The at least two upper walls have a first surface and a second surface. The first surface defines an outer surface of the upper member. The second surface cooperates with the top wall to define an inner surface of the upper member. The upper walls include at least two flap portions formed from the upper walls. The flap portions remain attached to the base member when the upper member is removed from the base member and extend across a portion of the base member.

This aspect of the disclosure may include one or more of the following optional features. In some examples, the flap portions are attached to one another to connect the upper walls to one another within the base member. The flap portions may attach to one another regardless of whether the upper member is attached to the base member. Additionally, the flap portions may cooperate to extend across a width of the base member and may extend substantially perpendicular to a longitudinal axis of the base member.

In some implementations, the flap portions have a shape defined by predetermined areas of weakness formed in the upper walls. The predetermined areas of weakness may be defined by perforations formed in the upper walls. Also, the flap portions may be separated from the upper walls along the perforations when the upper member is removed from the base member.

In some examples, the at least two base walls include four base walls and the at least four upper walls include four upper walls. A first flap portion is formed from one of the four upper walls and a second flap portion is formed from an upper wall opposing the upper wall from which the first flap portion is formed. In some implementations, a central hole is formed with the upper walls relative each of the flap portions. And, in some implementations, an access hole is formed within the base walls and a central flap is formed from one of the upper walls. The central flap, which is movable relative the upper wall, opens and closes the access hole.

Another aspect of the disclosure provides a method for constructing a retail case from a first sheet of material and a second sheet of material that includes attaching the first sheet of material to the second sheet of material, folding the attachment of the first and second sheets of material along a plurality of predefined scoring lines formed on the first sheet of material and the second sheet of material, and adhering a surface of an end flap to a surface of a wall. Attaching the first sheet of material to the second sheet of material includes adhering at least one attachment portion formed from the first sheet of material to the second sheet of material. At least one of the first sheet of material and the second sheet of material includes at least two walls, one of which is the wall the end flap is adhered to, and the end flap. The at least one attachment portion remains adhered to the second sheet of material when the first sheet of material detaches from the second sheet of material.

This aspect of the disclosure may include one or more of the following optional features. In some implementations, the method further includes attaching flap portions to one another to form a divider within the retail case. Two attachment portions embody the at least one attachment portion. Each of the two attachment portions associates with a flap portion movable relative the associated attachment portion.

In some examples, the flap portions are attached to one another regardless of whether the first sheet of material is attached to the second sheet of material. In some implementations, the flap portions cooperate to extend across a width of the retail case. And, in some examples, the flap portions extend substantially perpendicular to a longitudinal axis of the retail case.

In some examples, the at least one attachment portion has a shape defined by predetermined areas of weakness formed in the first sheet of material. Additionally, the predetermined areas of weakness may be defined by perforations formed in the first sheet of material. And the at least one attachment portion may be separated from the first sheet of material along the perforations when the first sheet of material is removed from the second sheet of material.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
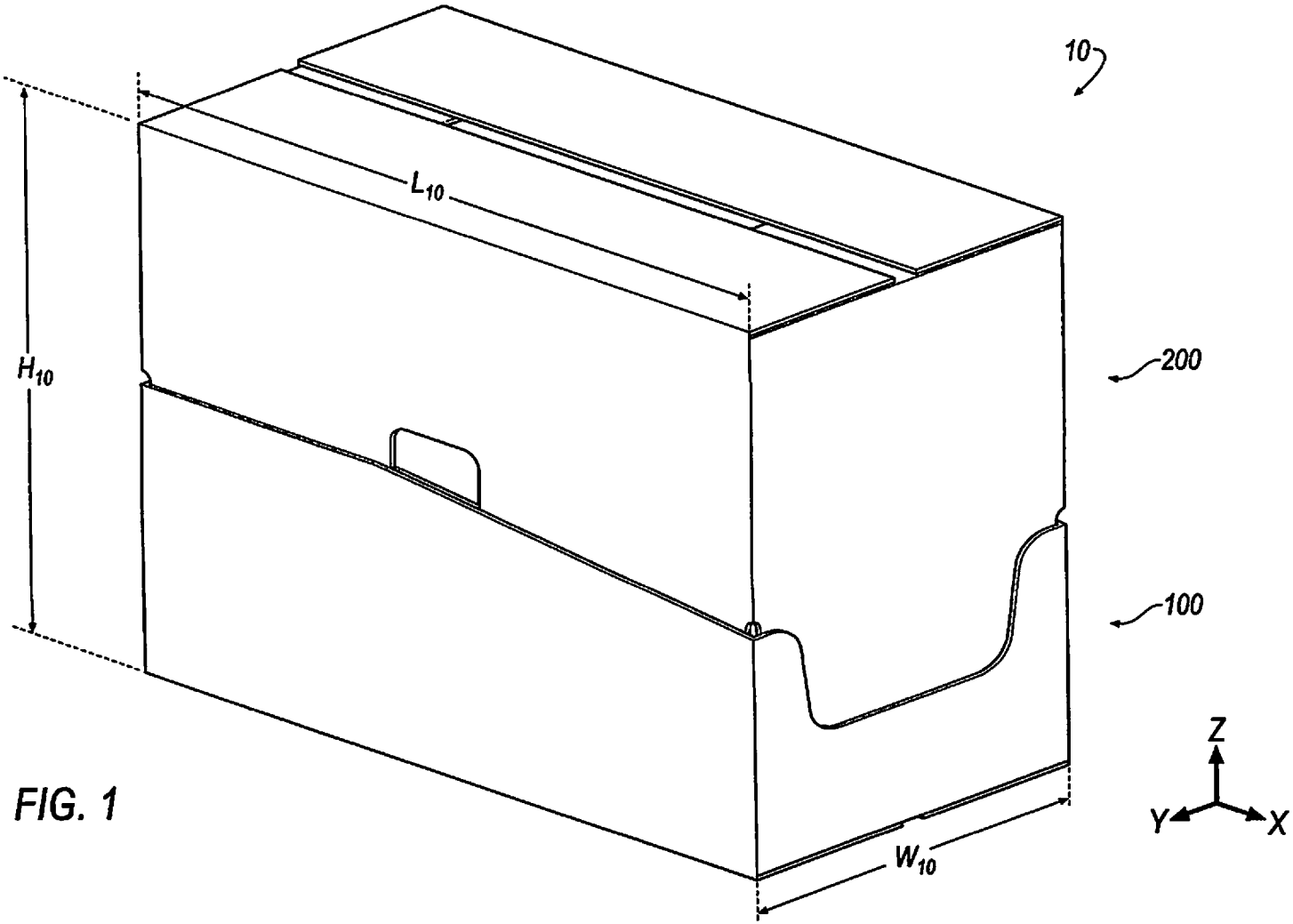
FIG. 1 is a perspective view of an example retail case having a base member and an upper member.

Referring to FIG. 1, the retail case 10 of the present disclosure takes the form of a display-ready, polyjoinder, regular slotted container (RSC) having a length $L_{10}$ extending along a longitudinal x-axis, a width $W_{10}$ extending along a transverse y-axis, and a height $H_{10}$ extending along a vertical z-axis. The length $L_{10}$ of the retail case 10, the width $W_{10}$ of the retail case 10, and the height $H_{10}$ of the retail case 10 may vary without deviating from the scope of this disclosure.

The retail case 10 is formed by the attachment of an upper member 200 to a base member 100. With the upper member 200 attached to the base member 100, the retail case 10 is capable of various functions, including shipping and/or storing of products within the retail case 10. The upper member 200 is capable of detaching from the base member 100 in order to transform the retail case 10 into a configuration that allows the retail case 10 to more readily display and/or dispense products contained within the retail case 10.

Figure 2A:
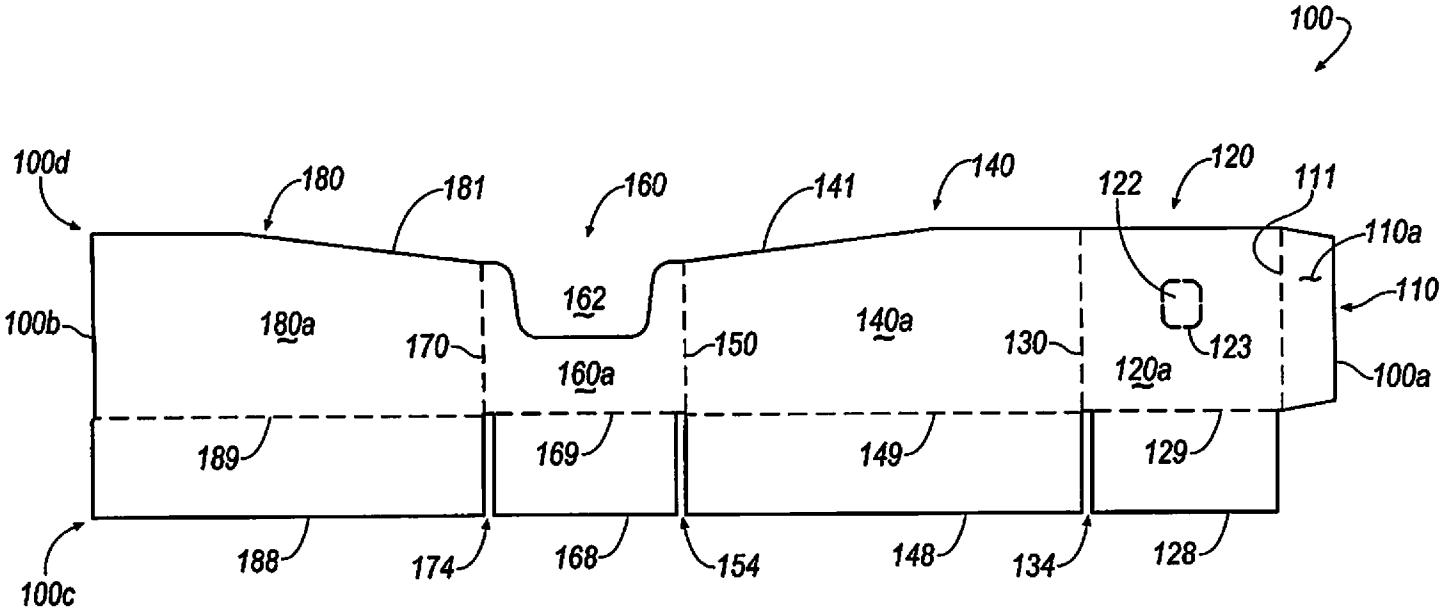
FIG. 2A is a plan view of the base member of the retail case of FIG. 1 in a pre-erected state showing an inner surface of the base member.
Figure 2B:
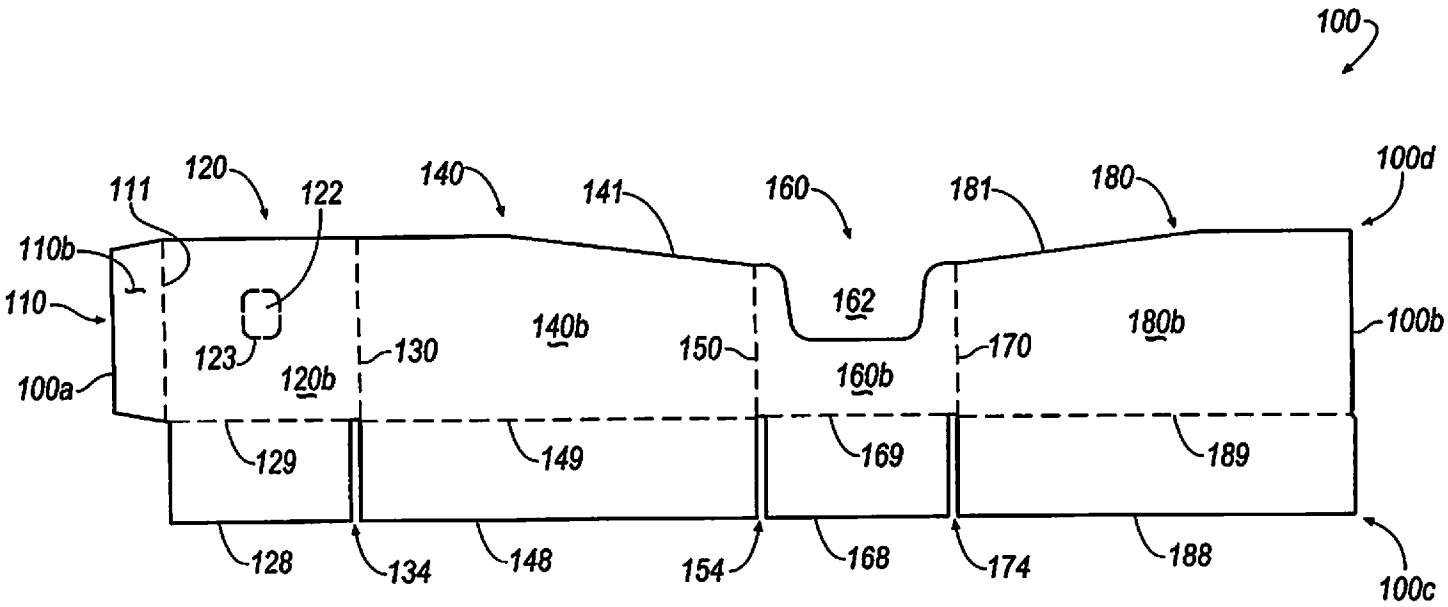
FIG. 2B is a plan view of the base member of the retail case of FIG. 1 in the pre-erected state showing an outer surface of the base member.
Figure 3:
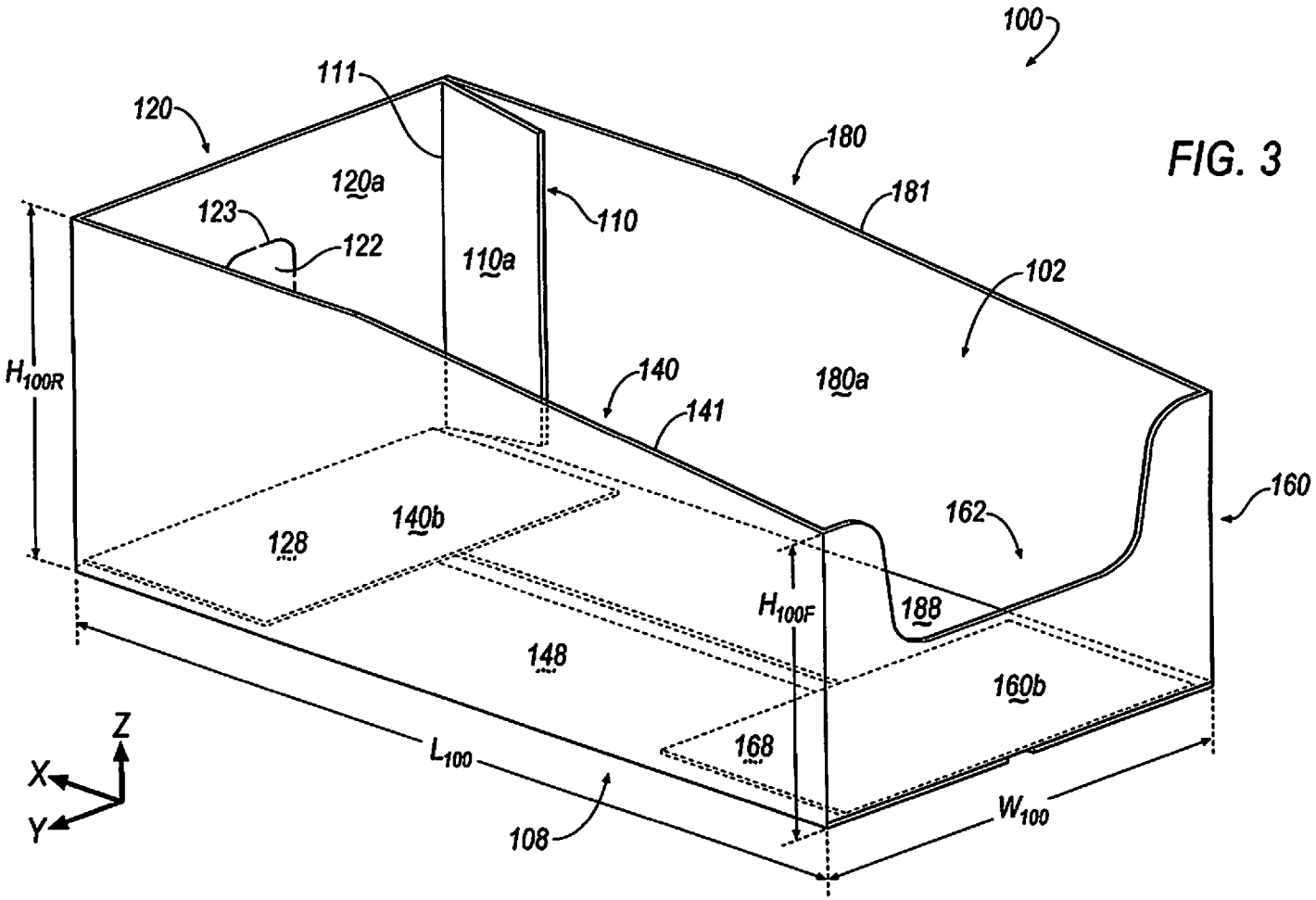
FIG. 3 is a perspective view of the base member of the retail case of FIG. 1 in an erected state.

The base member 100 of the retail case 10 and the upper member 200 of the retail case 10 may each be implemented in a number of different forms without deviating from the scope of this disclosure. For example, the base member 100 and the upper member 200 may each include any number of wall sections (more or less than the four wall sections illustrated in FIG. 1), each of which may take on any shape and size and may include any optional features that permit the retail case 10 to serve its intended purpose, as described herein. One exemplary implementation of the base member 100 of the retail case 10 is illustrated in FIGS. 2A, 2B, and 3. One exemplary implementation of the upper member 200 of the retail case 10 is illustrated in FIGS. 4A, 4B, 5A, and 5B. However, this disclosure is not limited to only these exemplary implementations of the base member 100 and the upper member 200.

Referring to FIGS. 2A-2B, a base member 100 of the retail case 10 takes the form of an integral sheet of material prior to its erection. The base member 100 extends from a first end 100*a* to a second end 100*b*. When the base member 100 takes its erected state, the first end 100*a* of the base member 100 attaches to the second end 100*b* of the base member 100. Additionally, the base member 100 includes a bottom end 100*c* at which a bottom wall 108 (shown in FIG. 3) of the base member 100 is formed when the base member 100 takes its erected state. The base member further includes an open end 100*d* at which an opening 102 (shown in FIG. 3) into the base member 100 forms when the base member 100 takes its erected state.

The exemplary implementation of the base member 100 shown in FIGS. 2A-2B includes a base-end flap 110 located at the first end 100*a* of the base member 100 that extends from the open end 100*d* of the base member 100 towards the bottom end 100*c* of the base member 100 near the point at which the bottom wall 108 will be formed when the base member 100 is formed into the erect state. The base member 100 may utilize a base-end flap 110 that is of a different shape and/or a different size than the base-end flap 110 shown in FIGS. 2A-2B. Also, the base member 100 may not include a base-end flap 110 at its first end 100*a*, in which case a similar base-end flap 110 could be included at the second end 100*b* of the base member 100. Further, the base member 100 could be constructed without a base end flap 110 altogether.

A first base wall 120 connects to the base-end flap 110 at a scoring line 111 and a bottom flap 128 connects to the first base wall 120 at a scoring line 129. The bottom flap 128 does not extend across the entire length of the first base wall 120, thereby allowing a slot 134 to form adjacent to the bottom flap 128. This slot 134 is an optional feature that may increase the ease of creasing the scoring line 129 when the bottom flap 128 forms a portion of the bottom wall 108 during erection of the base member 100.

In the exemplary implementation of the base member 100 shown in FIGS. 2A-2B, the first base wall 120 includes the optional feature of an access hole 122, which is defined by a predetermined area of weakness 123 formed in the material of the first base wall 120. In some examples, the predetermined area of weakness 123 is implemented as a perforation 123, which may consist of a series of punctures to allow easy separation along the path of the perforation 123, formed into the material of the first base wall 120. At any time, whether the base member 100 resides in its integral sheet form or its erected form, the perforation 123 may be severed to open the access hole 122, which may provide visual or other sensory access to any items or product residing within the retail case 10. The only access hole 122 of the exemplary implementation of the base member 100 shown in FIGS. 2A-2B is included on the first base wall 120. However, other implementations of the base member 100 may include more than one access hole 122 or, alternatively, the base member 100 may be designed without an access hole 122 altogether, in which case the upper member 200 may include one or more access holes 122 or the retail case 10 may be designed without access holes 122 on either the base member 100 or the upper member 200.

A second base wall 140 connects to the first base wall 120 at a scoring line 130. A bottom flap 148 connects to the second base wall 140 at a scoring line 149. The edge 141 of the second base wall 140 at the open end 100*d* of the base member 100 bends to vary the height of the second base wall 140. In alternate implementations, the edge 141 of the second base wall 140 may not bend, which results in the second base wall 140 having a substantially constant height. Alternatively, the edge 141 may bend in a different fashion to vary the height of the second base wall 140 in a different manner than shown in the implementation of FIGS. 2A-2B.

A third base wall 160 connects to the second base wall 140 at a scoring line 150. A bottom flap 168 connects to the third base wall 160 at a scoring line 169. The bottom flap 168 does not extend across the entire length of the third base wall 160, thereby allowing two slots 154, 174 to form adjacent to the bottom flap 168. These slots 154, 174 are an optional feature that may increase the ease of creasing the scoring line 169 when the bottom flap 168 forms a portion of the bottom wall 108 during erection of the base member 100.

In the exemplary implementation of the base member 100 shown in FIGS. 2A-2B, the third base wall 160 includes the optional feature of a cutout 162 located at the open end 100*d* of the base member 100. The cutout 162 improves the display and accessibility of any items or products residing within the base member 100 of the retail case 10. The only cutout 162 of the exemplary implementation of the base member 100 shown in FIGS. 2A-2B is included on the third base wall 160. However, other implementations of the base member 100 may include more than one cutout 162 or, alternatively, the base member may be designed without a cutout 162.

A fourth base wall 180 connects to the third base wall 160 at a scoring line 170. The end of the fourth base wall 180 opposing the scoring line 170 forms the second end 100*b* of the base member 100. A bottom flap 188 connects to the fourth base wall 180 at a scoring line 189. An edge 181 of the fourth base wall 180 at the open end 100*d* of the base member 100 bends to vary the height of the fourth base wall 180. In alternate implementations, this edge 181 may not bend, thereby resulting in the height of the fourth base wall 180 being substantially constant. Alternatively, the edge 181 may bend in a different fashion to vary the height of the fourth base wall 180 in a different manner than shown in the implementation of FIGS. 2A-2B.

FIG. 2A illustrates one surface—the inner surface—of the base member 100. FIG. 2B illustrates the opposing surface—the outer surface—of the base member 100. Accordingly, in FIG. 2A, the inner surface 110*a* of the base end flap 110, the inner surface 120*a* of the first base wall 120, the inner surface 140*a* of the second base wall 140, the inner surface 160*a* of the third base wall 160, and the inner surface 180*a* of the fourth base wall 180 are shown. Conversely, in FIG. 2B, the outer surface 110*b* of the base end flap 110, the outer surface 120*b* of the first base wall 120, the outer surface 140*b* of the second base wall 140, the outer surface 160*b* of the third base wall 160, and the outer surface 180*b* of the fourth base wall 180 are shown. One or more of outer surface 120*b*, 140*b*, 160*b*, and 180*b* may include graphics that identify or otherwise advertise the product contained therein.

As previously discussed, the second base wall 140 and the fourth base wall 180 respectively include an edge 141, 181 located at the open end 100*d* of the base member 100 that bends to vary the height of the base walls 140, 180. Although this is not shown on the first base wall 120 or the third base wall 160, these walls 120, 160 may also include an edge located at the open end 100*d* of the base member 100 that bends to vary the height of that particular base wall 120, 160 as well.

Referring to FIG. 3, the base member 100 of the retail case 10 is capable of being erected from its form as a substantially flat sheet of material into its erected state. In its erected state, the first base wall 120 of the base member 100 opposes the third base wall 160 of the base member 100, the second base wall 140 of the base member 100 opposes the fourth base wall 180 of the base member 100, and the bottom flaps 128, 148, 168, 188 form a bottom wall 108 that opposes an opening 102 into the base member 100.

To erect the base member 100, the base member 100 is creased along scoring lines 111, 130, 150, 170. The first end 100*a* of the base member 100 is attached to the second end 100*b* of the base member 100 when the base-end flap 110 is adhered, at its outer surface 110*b*, to the fourth base wall 180 at its inner surface 180*a*. Next, scoring lines 129, 149, 169, 189 are creased, which allows the bottom flaps 128, 148, 168, 188 to form the bottom wall 108. A suitable adhesive may be provided at the junction of the base-end flap 110 and the fourth base wall 180 and/or at the junctions of the various flaps 128, 148, 168, 188 to maintain the base member 100 in the erected state shown in FIG. 3.

In the erected state, the base member 100 has a constant length $L_{100}$ along a longitudinal x-axis and a constant width $W_{100}$ along a transverse y-axis. The height of the base member 100 along a vertical z-axis varies from a front height $H_{100F}$ to a rear height $H_{100R}$. This variation in the height of the base member 100 is an optional feature created due to the shape of the edges 141, 181 of the second base wall 140 and the fourth base wall 180, respectively, at the open end 100*d* of the base member 100, as described previously. While the base member 100 is shown and described as having a varying height along the z-axis, the base member 100 could alternatively have a substantially constant height along the z-axis. Further, while the base member 100 is shown and described as including a substantially constant length and width along the respective x-axis and y-axis, the base member 100 could alternatively have a width and/or length that varies along the x-axis and y-axis without deviating from the scope of this disclosure.

Figure 4A:
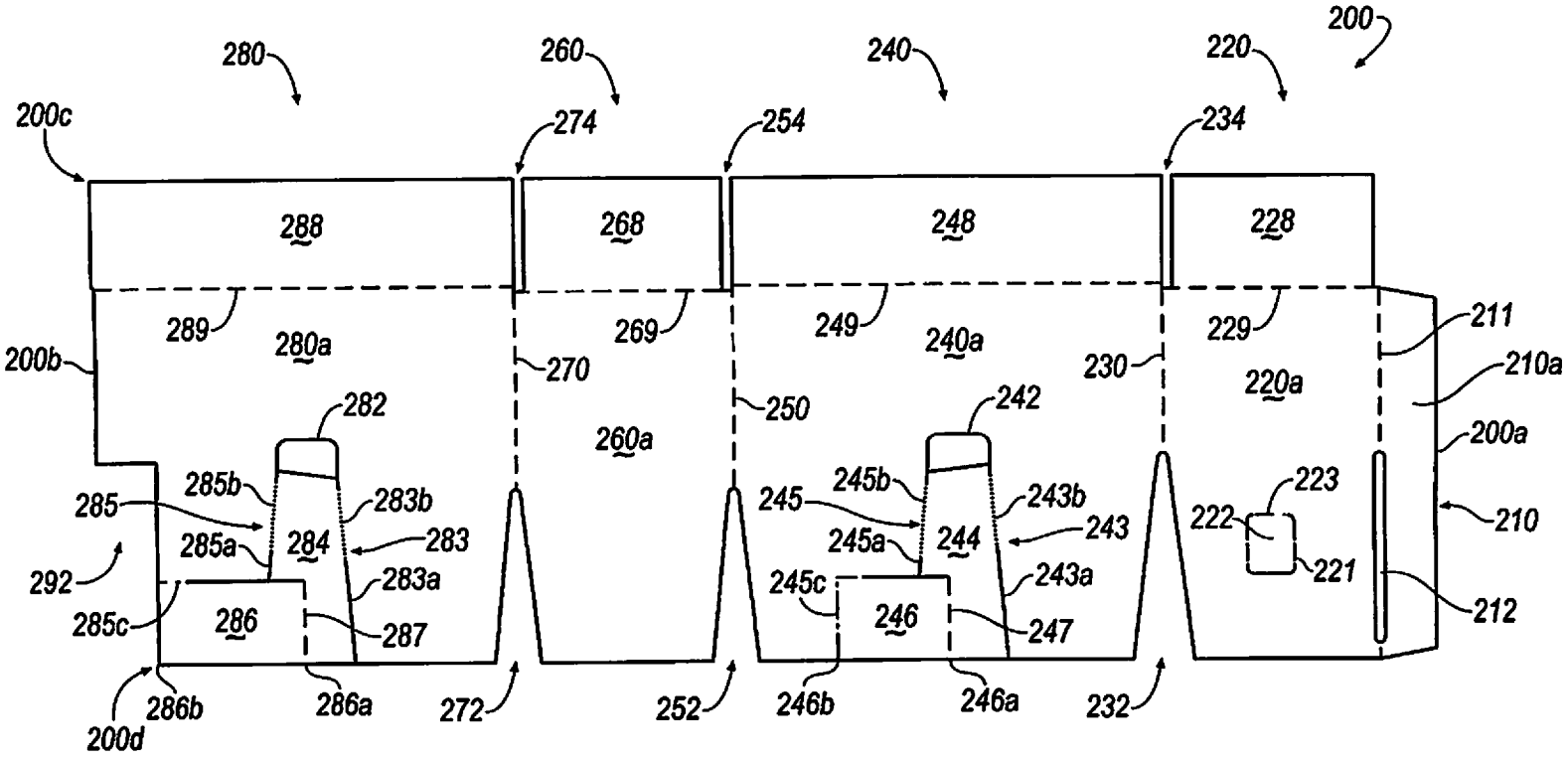
FIG. 4A is a plan view of the upper member of the retail case of FIG. 1 in a pre-erected state showing an inner surface of the upper member.
Figure 4B:
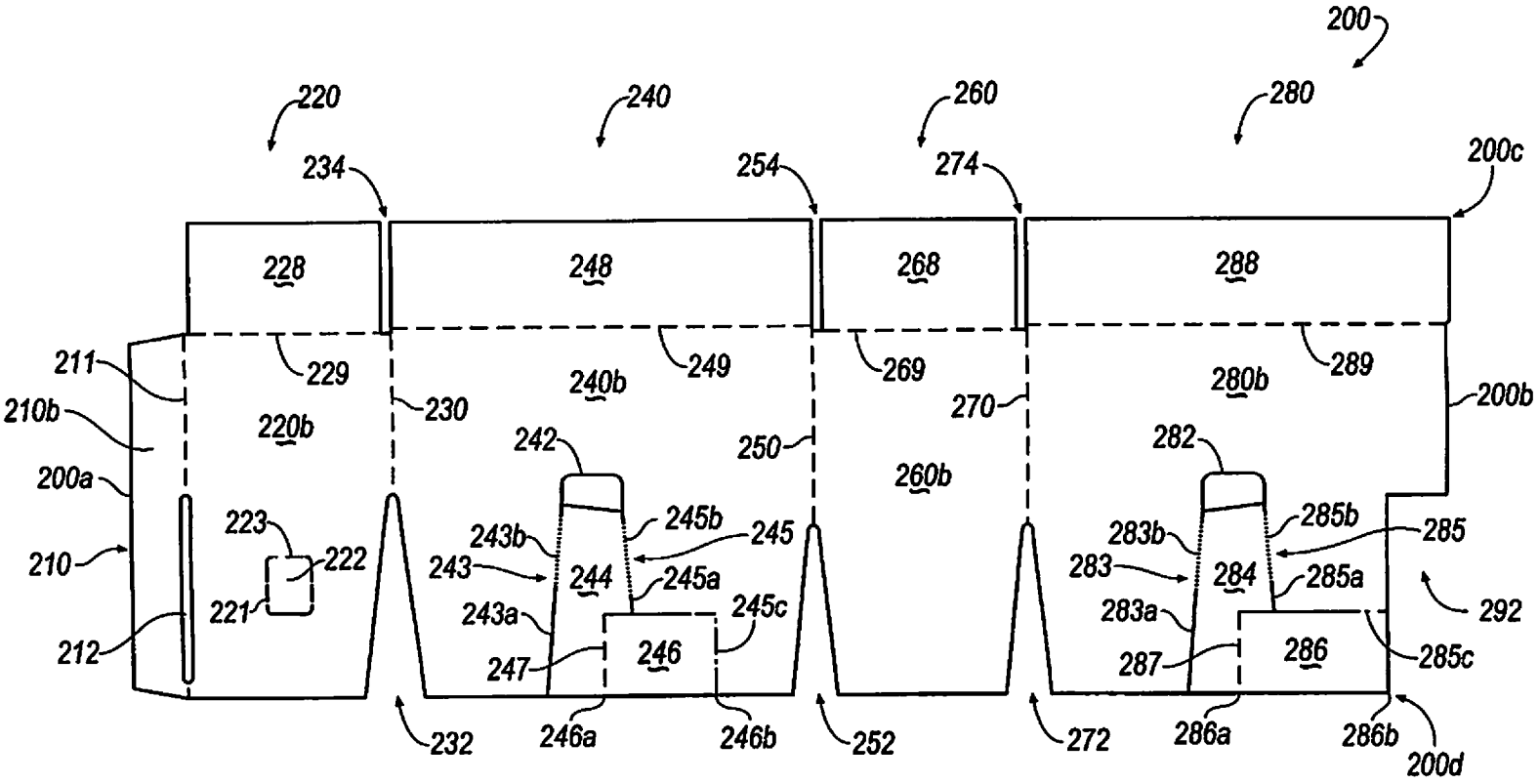
FIG. 4B is a plan view of the upper member of the retail case of FIG. 1 in the pre-erected state showing an outer surface of the upper member.

Referring to FIGS. 4A-4B, an upper member 200 of the retail case 10 takes the form of an integral sheet of material prior to its erection. The upper member 200 extends from a first end 200*a* to a second end 200*b*. When the upper member 200 takes its erected form, the first end 200*a* of the upper member 200 attaches to the second end 200*b* of the upper member 200. Additionally, the upper member 200 includes an upper end 200*c* at which a top wall 208 (shown in FIG. 5A) of the upper member 200 is formed when the member 200 takes its erected form. The upper member 200 further includes an open end 200*d* at which an opening 202 (shown in FIG. 5B) into the upper member 200 forms when the upper member 200 takes its erected form.

The exemplary implementation of the upper member 200 shown in FIGS. 4A-4B includes an upper-end flap 210 at the first end 200*a* of the upper member 200. The upper-end flap 210 extends from the open end 200*d* of the upper member 200 towards the upper end 200*c* of the upper member 200 near to a point at which the top wall 208 will be formed. The upper member 200 may utilize an upper-end flap 210 that is of a different shape or a different size than the upper-end flap 210 shown in FIGS. 4A-4B. Also, the upper member 200 may not include an upper-end flap 210 at its first end 200*a*, in which case a similar upper-end flap 210 could be included at the second end 200*b* of the upper member 200. Alternatively, the upper member 200 could be constructed without an upper-end flap 210 altogether.

A first upper wall 220 connects to the upper-end flap 210 at a scoring line 211. A top flap 228 connects to the first upper wall 220 at a scoring line 229. The top flap 228 does not extend across the entire length of the first upper wall 220, thereby allowing a slot 234 to form adjacent to the top flap 228. This slot 234 is an optional feature that may increase the ease of creasing the scoring line 229 when the top flap 228 forms a portion of the top wall 208 during erection of the upper member 200.

In the exemplary implementation of the upper member 200 shown in FIGS. 4A-4B, the scoring line 211 does not extend the full height of the upper-end flap 210 and first upper wall 220. Instead, a cutout 212 replaces a portion of the scoring line 211. In alternate implementations of the upper member 200, the cutout 212 may replace a different portion, a smaller portion, or a larger portion of the scoring line 211 or, alternatively, the upper member 200 may be designed without such a cutout 212 such that the scoring line 211 extends across the full height of the first upper wall 220.

In the exemplary implementation of the upper member 200 shown in FIGS. 4A-4B, the first upper wall 220 includes the optional feature of a central flap 222, which is defined by a scoring line 223 and a predetermined area of weakness 221 formed into the material of the first upper wall 220. In some examples, the predetermined area of weakness 221 is implemented as a perforation 221, which may consist of a series of punctures to allow easy separation along the path of the perforation 221 formed in the material of the first upper wall 220. In other examples, the predetermined area of weakness 221 is implemented as a cut line formed within the first upper wall 220. The central flap 222 associates with the access hole 122 formed in the first base wall 120 of the base member 100. The material of the first base wall 120 that is removed to open the access hole 122 may be adhered to the central flap 222, thereby allowing selective opening and closing of the access hole 122 depending on the position of the central flap 222. Such a construction allows the central flap 222 to be movable relative the first upper wall 220 by creasing or straightening the scoring line 223. When the scoring line 223 is not creased, the removed material of the first base wall 120 would return to its position within the first base wall 120, thereby closing the access hole 122. The only central flap 222 of the exemplary implementation of the upper member 200 shown in FIGS. 4A-4B is included on the first upper wall 220. However, other implementations of the upper member 200 may include more than one central flap 222 or, alternatively, the upper member 200 may be designed without a central flap 222 altogether.

A second upper wall 240 connects to the first upper wall 220 at a scoring line 230. A top flap 248 connects to the second upper wall 240 at a scoring line 249. Formed into the second upper wall 240 are a central opening 242, an attachment portion 244, and a flap portion 246 associated with the attachment portion 244. The attachment portion 244 and flap portion 246 are defined by a first predetermined area of weakness 243 formed in the second upper wall 240 and a second predetermined area of weakness 245 formed in the second upper wall 240. The first predetermined area of weakness 243, which extends from the central opening 242 to the open end 200*d* of the upper member 200, and includes a pre-cut line 243*a* and a tear-away line 243*b*. The second predetermined area of weakness 245, which extends from the central opening 242 to the open end 200*d* of the upper member 200, includes a pre-cut line 245*a*, a tear-away line 245*b*, and a perforation 245*c*. The perforation 245*c* may consist of a series of punctures formed into the material of the second upper wall 240 to allow easy separation along the path of the perforation 245*c*.

The attachment portion 244 remains connected to the remainder of the second upper wall 240 at the tear-away lines 243*b*, 245*b* until the tear-away lines 243*b*, 245*b* are torn to separate the attachment portion 244, with the flap portion 246, from the remainder of the second upper wall 240. As will be described below, such separation occurs when the upper member 200 is removed from the base member 100.

The flap portion 246 that is associated with the attachment portion 244 extends from a first end 246*a* to a second end 246*b*, and the first end 246*a* of the flap portion 246 connects to the attachment portion 244 at scoring line 247. A portion of the pre-cut line 245*a* separates the flap portion 246 from the remainder of the second upper wall 240. The flap portion 246, near and along its second end 246*b*, remains connected to the remainder of the second upper wall 240 at the perforation 245*c* until the perforation 245*c* is severed to fully separate the flap portion 246 from the second upper wall 240 except for the connection to the attachment portion 244 along the scoring line 247, as will be described below in greater detail.

A third upper wall 260 connects to the second upper wall 240 at a scoring line 250. A top flap 268 connects to the third upper wall 260 at a scoring line 269. The top flap 268 does not extend across the entire length of the third upper wall 260, thereby allowing two slots 254, 274 to form adjacent to the top flap 268. These slots 254, 274 are an optional feature that may increase the ease of creasing the scoring line 269 when the top flap 268 forms a portion of the top wall 208 during erection of the upper member 200.

A fourth upper wall 280 connects to the third upper wall 260 at a scoring line 270. The end of the fourth upper wall 280 opposing the scoring line 270 forms the second end 200*b* of the upper member 200. A top flap 288 connects to the fourth upper wall 280 at a scoring line 289. Formed in the fourth upper wall 280 are a central opening 282, an attachment portion 284, and a flap portion 286 associated with the attachment portion 284. The attachment portion 284 and flap portion 286 are defined by a first predetermined area of weakness 283 formed in the fourth upper wall 280 and a second predetermined area of weakness 285 formed in the fourth upper wall 280. The first predetermined area of weakness 283, which extends from the central opening 282 to the open end 200*d* of the upper member 200, includes a pre-cut line 283*a* and a tear-away line 283*b*. The second predetermined area of weakness 285, which extends from the central opening 282 towards the open end 200*d* of the upper member 200 and to the second end 200*b* of the upper member 200, includes a pre-cut line 285*a*, a tear-away line 285*b*, and a perforation 285*c*. The perforation 285*c* may consist of a series of punctures formed into the material of the fourth upper wall 280 to allow easy separation along the path of the perforation 285*c*.

The attachment portion 284 remains connected to the remainder of the fourth upper wall 280 at the tear-away lines 283*b*, 285*b* until the tear-away lines 283*b*, 285*b* are torn to separate the attachment portion 284, with the flap portion 286, from the remainder of the fourth upper wall 280. As will be described below, such separation occurs when the upper member 200 is removed from the base member 100.

The flap portion 286 that is associated with the attachment portion 284 extends from a first end 286*a* to a second end 286*b*, with the first end 286*a* of the flap portion 286 being connected to the attachment portion 284 at a scoring line 287. A portion of the pre-cut line 285*a* separates the flap portion 286 from the remainder of the fourth upper wall 280. The flap portion 286, near its second end 286*b*, remains connected to the remainder of the fourth upper wall 280 at the perforation 285*c* until the perforation 285*c* is severed to fully separate the flap portion 286 from the fourth upper wall 280 except for the connection to the attachment portion 284 at scoring line 287.

Formed at the open end 200*d* of the upper member 200 are a first cutout 232 between the first upper wall 220 and the second upper wall 240, a second cutout 252 between the second upper wall 240 and the third upper wall 260, a third cutout 272 between the third upper wall 260 and the fourth upper wall 280, and a fourth cutout 292 proximate to the fourth upper wall 280 at the second end 200*b* of the upper member 200. The cutouts 232, 252, 272, 292 allow for an easier erection of the retail case 10 when the base member 100 and the upper member 200 are attached.

The central holes 282, 242 allow a user to grasp the upper member 200 proximate to the areas of weakness 243, 245, 283, 285 to facilitate tearing of the tear-away lines 243*b*, 245*b*, 283*b*, 285*b* when a force of a predetermined magnitude is applied to the upper member 200. Accordingly, it is advantageous to include a central opening 282, 242 adjacent to each attachment portion 244, 284 of the upper member 200. Additionally, the central openings 282, 242 may aid in the handling and transporting of the retail case 10. Alternate implementations of the disclosure may include central openings 242, 282 at different or additional locations on the upper member 200.

FIG. 4A illustrates one surface—the inner surface—of the upper member 200. FIG. 4B illustrates the opposing surface—the outer surface—of the upper member 200. Accordingly, in FIG. 4A, the inner surface 210*a* of the upper-end flap 210, the inner surface 220*a* of the first upper wall 220, the inner surface 240*a* of the second upper wall 240, the inner surface 260*a* of the third upper wall 260, and the inner surface 280*a* of the fourth upper wall 280 are shown. Conversely, in FIG. 4B, the outer surface 210*b* of the upper-end flap 210, the outer surface 220*b* of the first upper wall 220, the outer surface 240*b* of the second upper wall 240, the outer surface 260*b* of the third upper wall 260, and the outer surface 280*b* of the fourth upper wall 280 are shown.

Figure 5A:
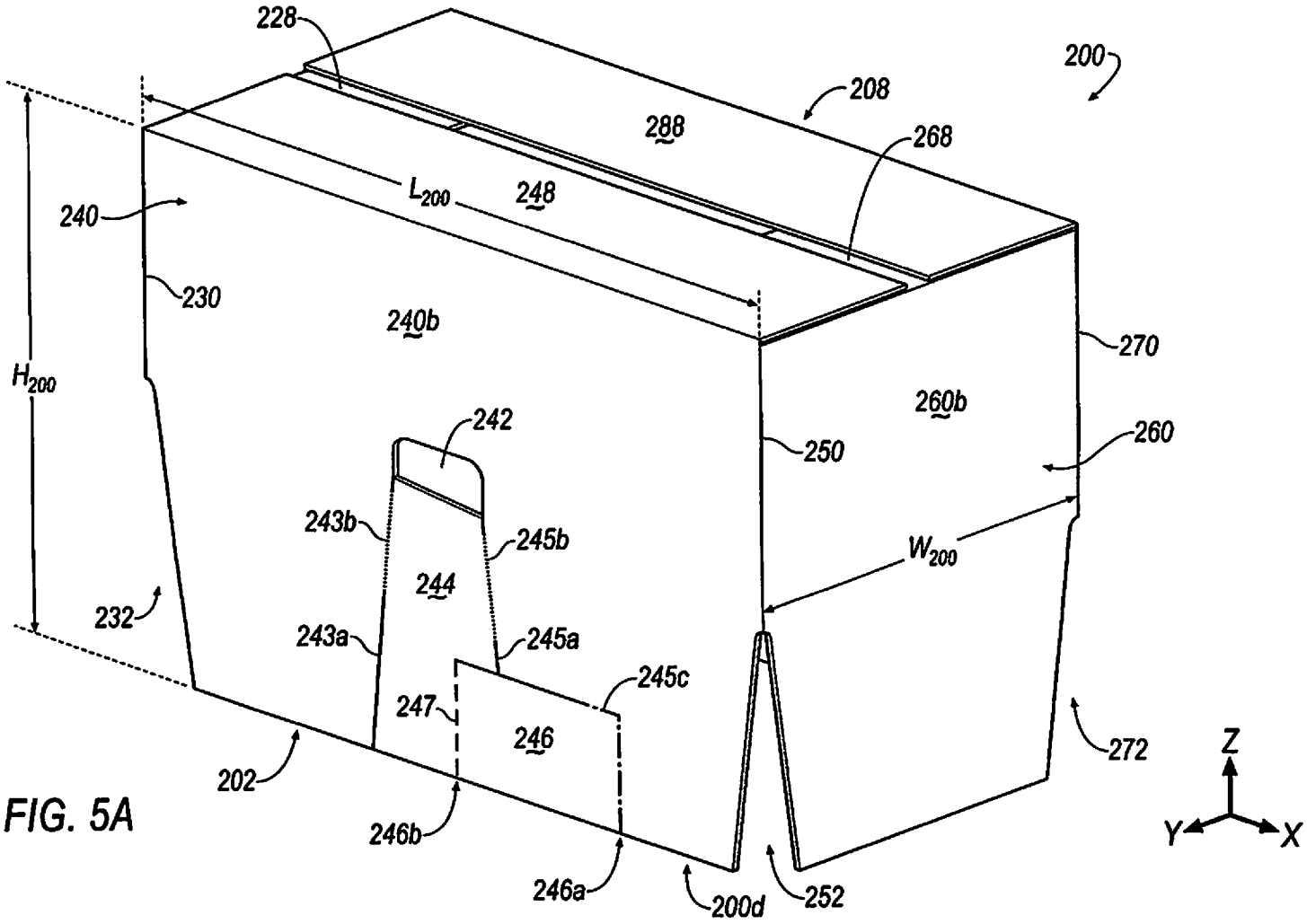
FIGS. 5A-5B are perspective views of the upper member of the retail case of FIG. 1 in an erected state.
Figure 5B:
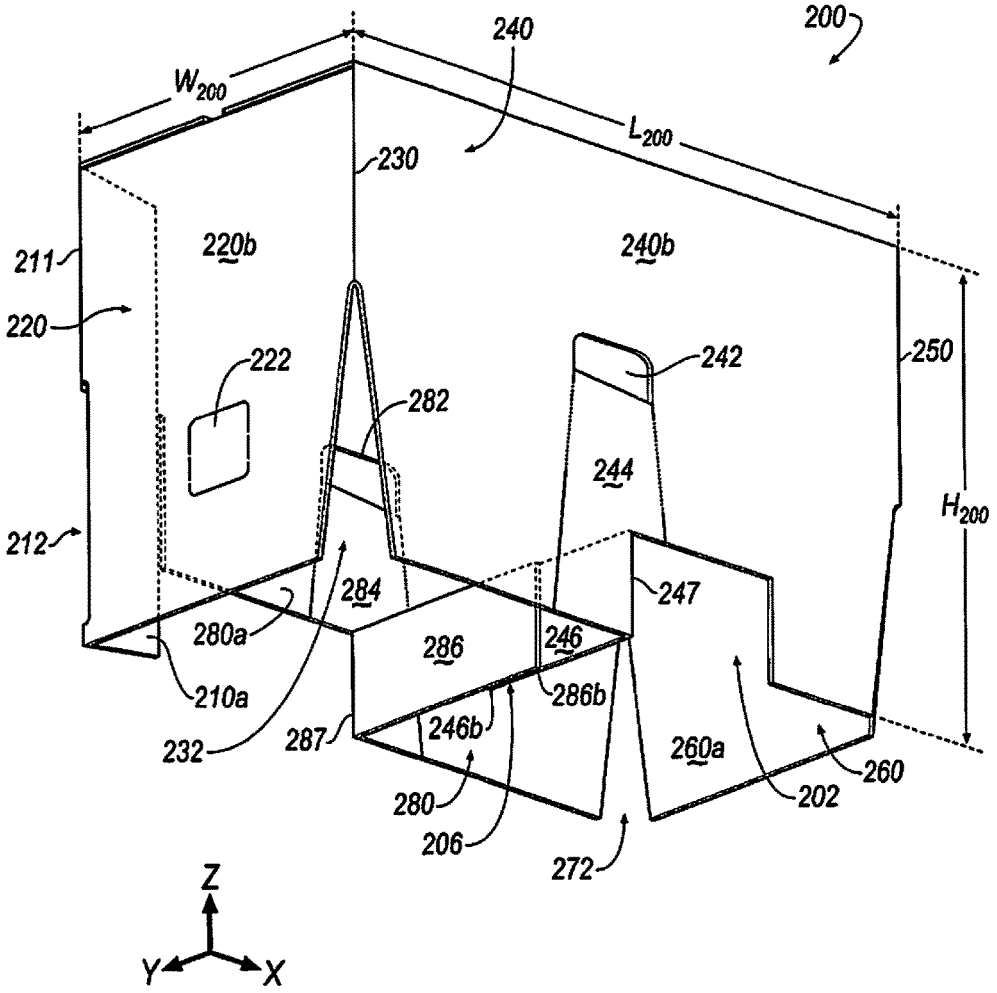

Referring to FIGS. 5A-5B, the upper member 200 of the retail case 10 is capable of being transformed from its form as a substantially flat sheet of material into its erected state. In its erected state, the first upper wall 220 of the upper member 200 opposes the third upper wall 260 of the upper member 200, the second upper wall 240 of the upper member 200 opposes the fourth upper wall 280 of the upper member 200, and the top flaps 228, 248, 268, 288 form a top wall 208 that opposes an opening 202 into the upper member 200.

To erect the upper member 200, the upper member 200 is creased along scoring lines 211, 230, 250, 270. The first end 200*a* of the upper member 200 is attached to the second end 200*b* of the upper member 200 when the upper-end flap 210 is adhered, at its outer surface 210*b*, to the fourth upper wall 280 at its inner surface 280*a*. Next, scoring lines 229, 249, 269, 289 are creased, which allows the top flaps 228, 248, 268, 288 to form the top wall 208. As with the base member 100, a suitable adhesive may be used at the junction of the upper-end flap 210 and the fourth upper wall 280 and at the various junctions of flaps 228, 248, 268, 288 to maintain the upper member 200 in the erected state.

In the erected state, the upper member 200 has a constant length L200 along a longitudinal x-axis, a constant width W200 along a transverse y-axis, and a constant height H200 along a vertical z-axis. In other implementations of the disclosure, the upper member 200 could alternatively have one or more of a length, a width, or a height that vary along one or more axes without deviating from the scope of this disclosure.

Once the perforations 245*c* (shown before severance in FIG. 5A and after severance in FIG. 5B), 285*c* (not shown in FIG. 5A and shown after severance in FIG. 5B) of the second predetermined areas of weakness 245, 285 are severed, the flap portions 246, 286 are movable relative to the attachment portions 244, 284 by creasing and straightening the scoring lines 247 (shown as straight in FIG. 5A and as creased in FIG. 5B), 287 (not shown in FIG. 5A and shown as creased in FIG. 5B). Referring specifically to FIG. 5B, the flap portions 246, 286 may be moved to a position that is substantially perpendicular to the longitudinal axis of the upper member 200 by rotating the second ends 246*b*, 286*b* toward the opposing upper wall 280 (for flap portion 246), 240 (for flap portion 286). The second upper wall 240 and the fourth upper wall 280 are connected when flap portion 246 is attached to flap portion 286 by adhering a first surface of the flap portion 246, near its second end 246*b*, to a first surface of the flap portion 286, near its second end 286*b* via a suitable adhesive. The attachment of the flap portion 246 to flap portion 286 forms a divider 206.

Figure 6A:
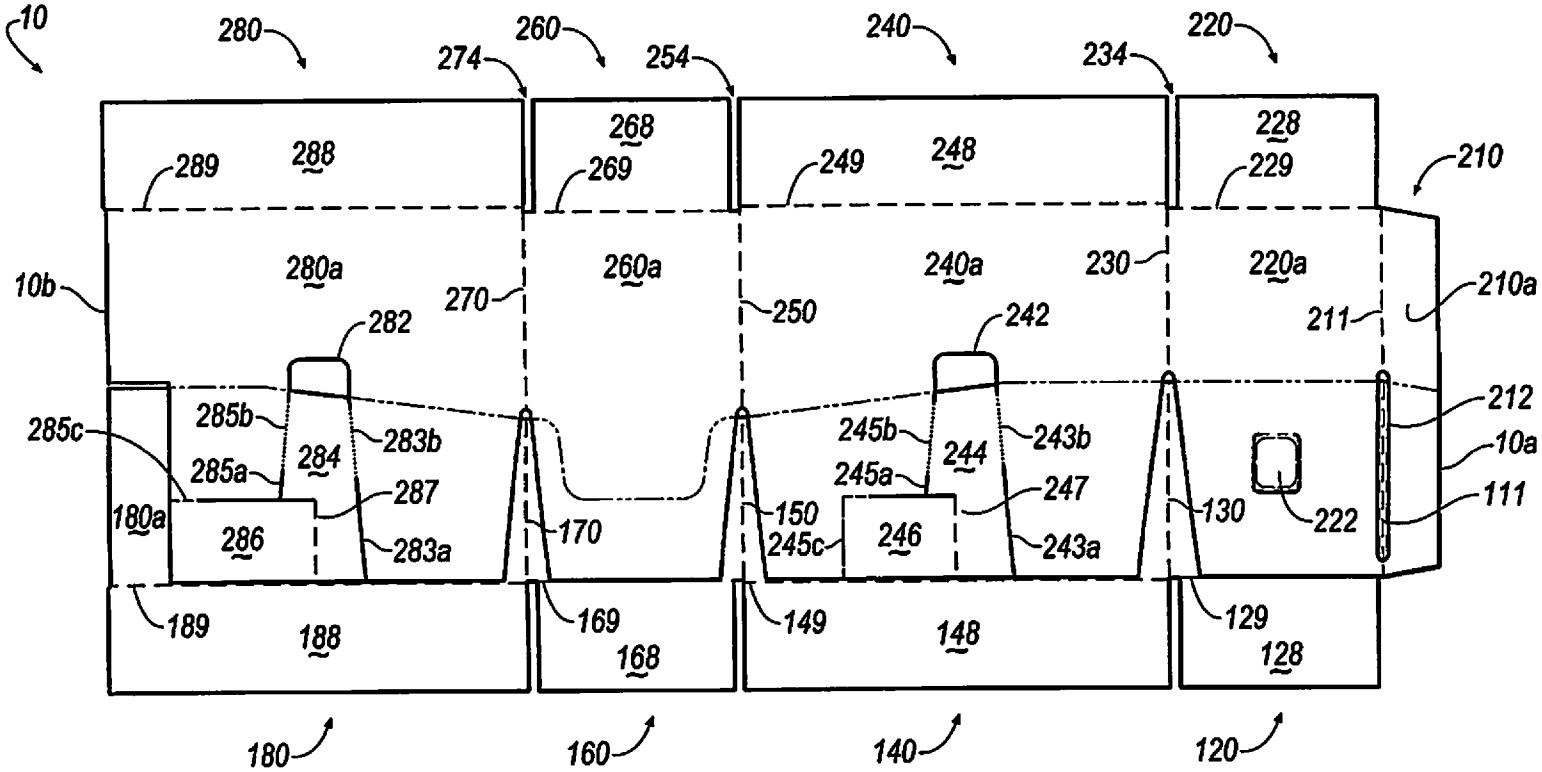
FIG. 6A is a plan view of the retail case of FIG. 1 in a pre-erected state showing an inner surface of the retail case with the base member attached to the upper member.
Figure 6B:
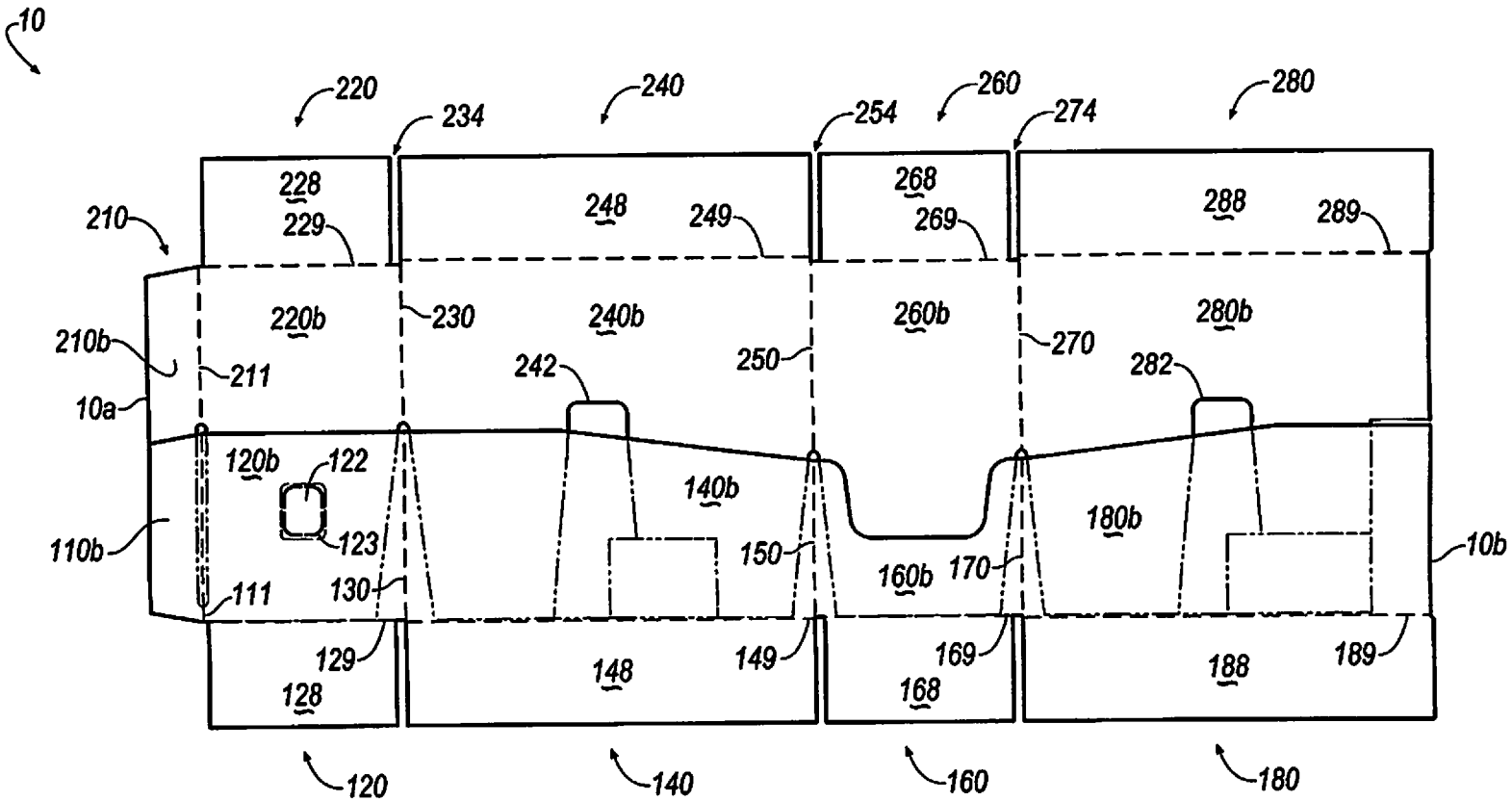
FIG. 6B is a plan view of the retail case of FIG. 1 in the pre-erected state showing an outer surface of the retail case with the base member attached to the upper member.

Up until this point, the base member 100 and the upper member 200 have been described as separate members of the retail case 10. While the base member 100 and the upper member 200 may be separately erected prior to their attachment to one another to form the retail case 10 without deviating from the scope of this disclosure, FIGS. 6A-6B illustrate that the base member 100 and the upper member 200 may be attached to one another prior to erection. In this configuration, both the base member 100 and the upper member 200 are formed from separate sheets of material that are attached to one another in the pre-erected state, as shown in FIGS. 6A and 6B. Attachment of the base member 100 to the upper member 200 defines the pre-erected form of the retail case 10. In its pre-erected form, the retail case 10 extends from a first end 10*a* to a second end 10*b* and includes four bottom flaps 128, 148, 168, 188 and four top flaps 228, 248, 268, 288.

Referring to FIGS. 6A-6B, the inner surface of the base member 100 is attached to the outer surface of the upper member 200 in a manner such that the inner surface 110*a* of the base end flap 110 contacts the outer surface 210*b* of the upper-end flap 210, the inner surface 120*a* of the first base wall 120 contacts the outer surface 220*b* of the first upper wall 220, the inner surface 140*a* of the second base wall 140 contacts the outer surface 240*b* of the second upper wall 240, the inner surface 160*a* of the third base wall 160 contacts the outer surface 260*b* of the third upper wall 260, and the inner surface 180*a* of the fourth base wall 180 contacts the outer surface 280*b* of the fourth upper wall. The scoring lines 130, 150, 170 of the base member 100 align with the respective scoring lines 230, 250, 270 of the upper member 200. Once properly aligned, a suitable adhesive may be used to maintain the relative position of the upper member 200 and the base member 100. The adhesive may be applied between the upper member 200 and the base member 100, as described below.

The attachment of the base member 100 to the upper member 200 is accomplished by adhering the outer surface of the attachment portion 244 of the upper member 200 to the inner surface 140*a* of the second base wall 140 of the base member 100 and adhering the outer surface of the attachment portion 284 of the upper member 200 to the inner surface 180*a* of the fourth base wall 180 of the base member 100. With the possible exception of some optional features—for example, the inner surface of the severable material forming the access hole 122 being adhered to the outer surface of the central flap 222—no portions of the upper member 200 other than the attachment portions 244, 284 are adhered to the base member 100 when the pre-erected form of the retail case 10 is formed.

FIG. 6A illustrates one surface—the inner surface—of the retail case 10. The upper member 200, shown lying atop the base member 100, covers a substantial portion of the inner surface of the base member 100, except the bottom flaps 128, 148, 168, 188 and a portion of the inner surfaces 120*a*, 140*a*, 160*a*, 180*a* of the base walls 120, 140, 160, 180 at the cutouts 232, 252, 272, 292 (labeled in FIGS. 4A-4B) of the upper member 200. FIG. 6B illustrates the opposing surface—the outer surface—of the retail case 10. The base member 100, shown lying atop the upper member 200, covers a portion of the outer surface of the upper member 200.

Figure 7A:
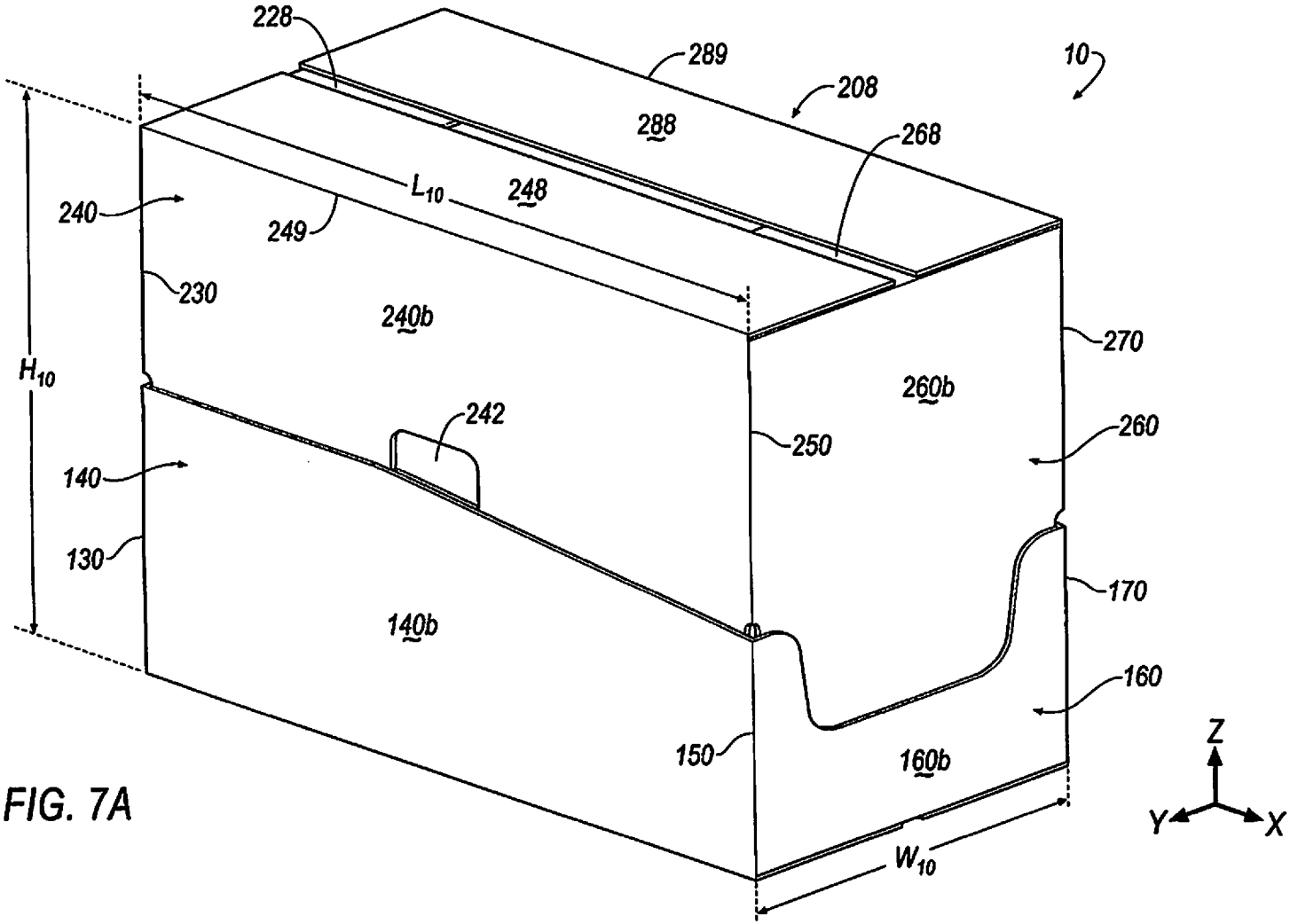
FIG. 7A is a perspective view of the retail case of FIG. 1 in an erected state with the base member attached to the upper member.
Figure 7B:
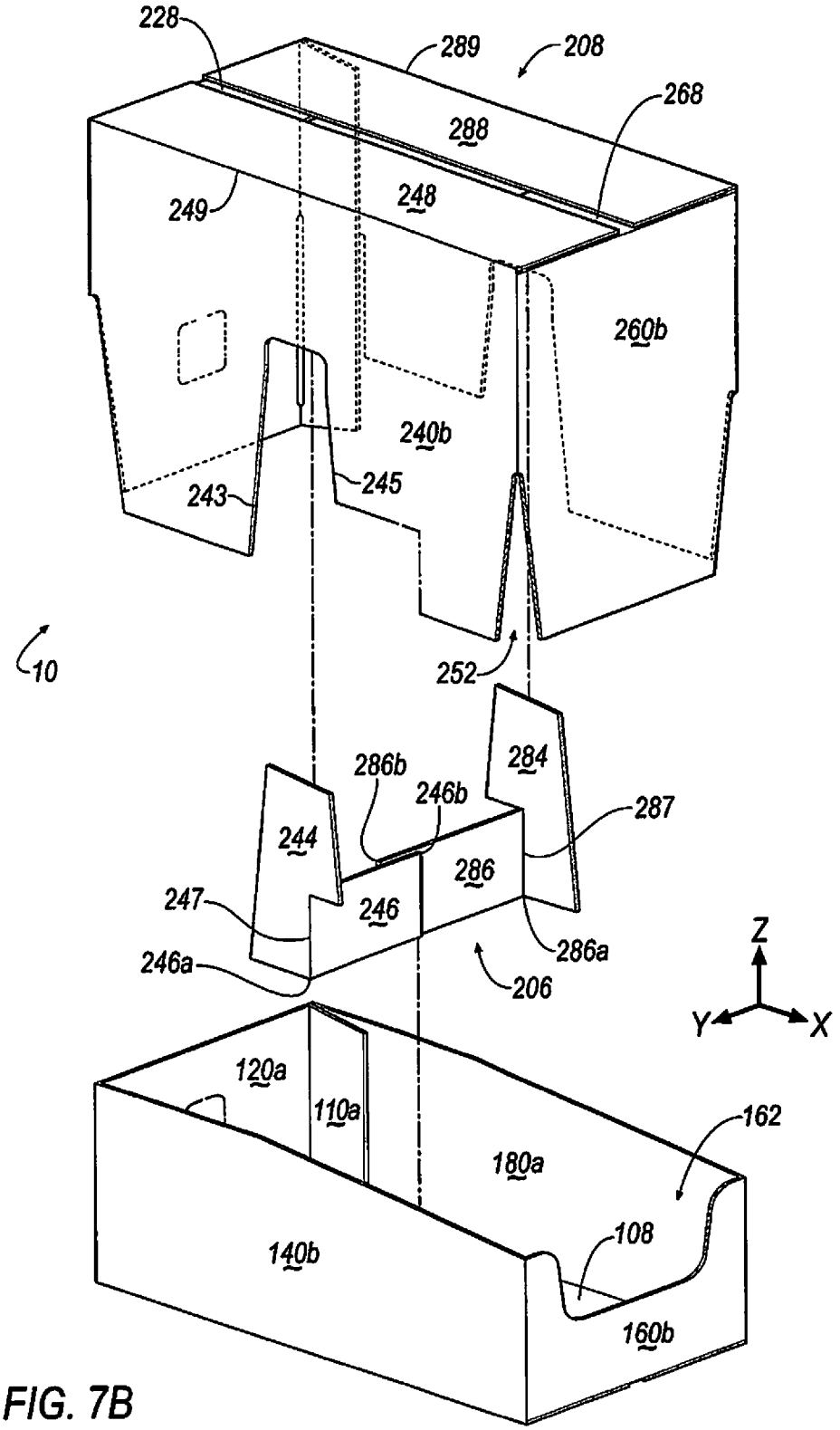
FIG. 7B is an exploded view of the retail case of FIG. 1 in an erected state with the base member attached to the upper member.

Upon attachment of the base member 100 to the upper member 200, the retail case 10 is capable of being erected from its pre-erected sheet form (as shown in FIGS. 6A-6B) into its erected state (as shown in FIGS. 7A-7B). In its erected state, the first wall section 120, 220 opposes the third wall section 160, 260, the second wall section 140, 240 opposes the fourth wall section 180, 280, and the bottom flaps 128, 148, 168, 188 form a bottom wall 108 that opposes a top wall 208 formed by the top flaps 228, 248, 268, 288.

To erect the retail case 10, scoring lines 111, 211, 130, 230, 150, 250, 170, 270 are creased to allow the first end 10*a* of the retail case 10 to be attached to the second end 10*b* of the retail case 10 when the end flaps 110, 210 are adhered, at their outer surfaces 110*b*, 210*b*, to the fourth walls 180, 280 at their inner surfaces 180*a*, 280*a*. Further, scoring lines 129, 149, 169, 189 are creased, which allows the bottom flaps 128, 148, 168, 188 to form the bottom wall 108 and scoring lines 229, 249, 269, 289 are creased, which allows the top flaps 228, 248, 268, 288 to form the top wall 208.

In the exemplary implementation of the retail case 10 shown in FIGS. 6A, 6B, 7A, and 7B, the first end 10*a* of the retail case 10 includes two end flaps—a base-end flap 110 of the base member 100 and an upper-end flap 210 of the upper member 200—that attach to the second end 10*b* of the retail case 10 when the retail case 10 takes its erected form (as shown in FIGS. 7A-7B). In the erected form of the retail case 10, the base end flap 110 of the base member 100 attaches to the second end 10*b* of the retail case 10 by adhering, at its outer surface 110*b*, only to the inner surface

Figure 8:
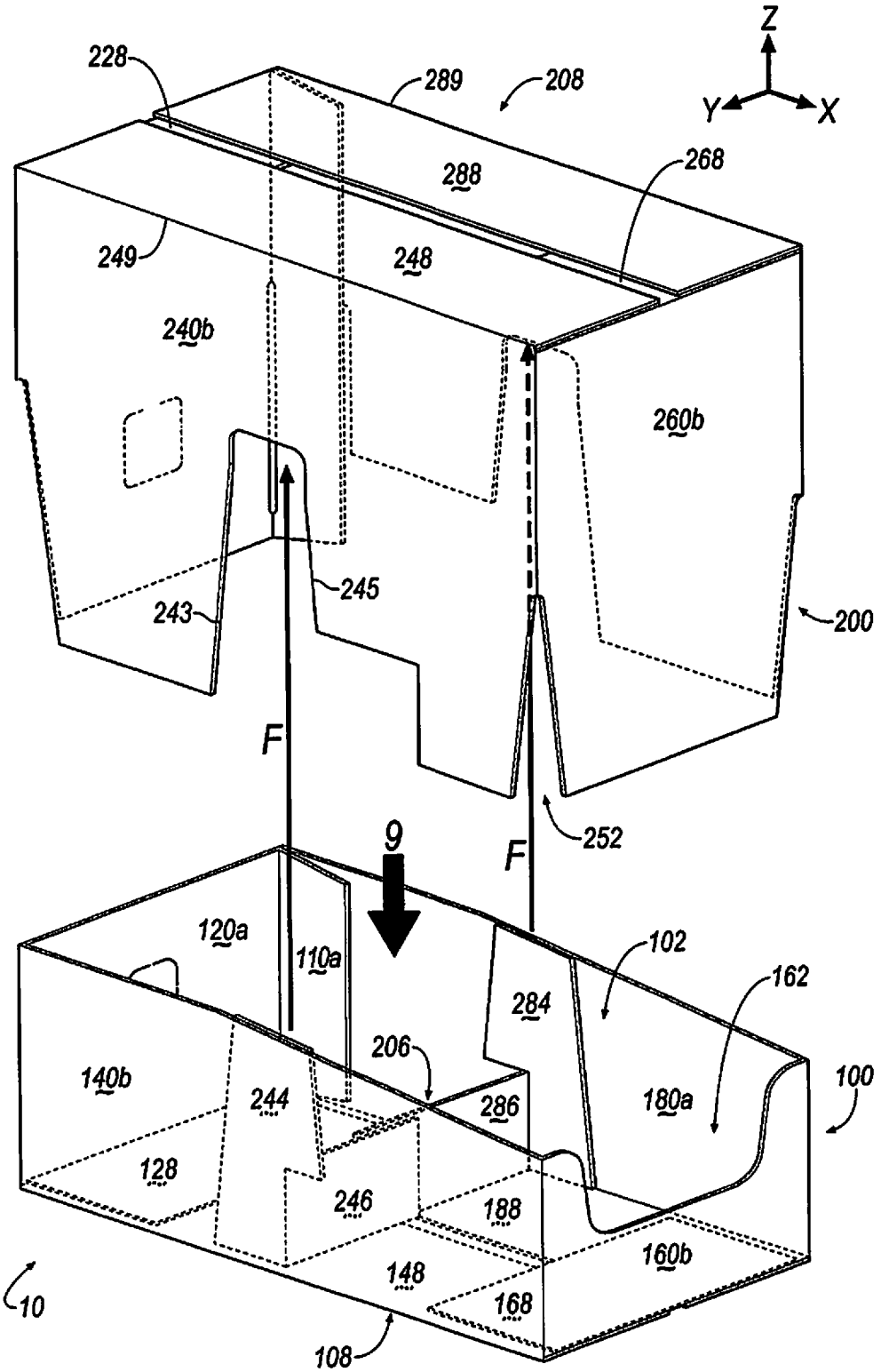
FIG. 8 is a perspective view of the retail case of FIG. 1 showing the upper member detached from the base member.

180*a* of the fourth base wall 180. Also, in the erected form of the retail case 10, the upper-end flap 210 of the upper member 200 attaches to the second end 10*b* of the retail case 10 by adhering, at its outer surface 210*b*, only to the inner surface 280*a* of the fourth upper wall 280. The base end flap 110 does not adhere to any portion of the upper member 200, and the upper-end flap 210 does not adhere to any portion of the base member 100. This configuration allows both the base member 100 and the upper member 200 to remain substantially in their erected forms when the upper member 200 is removed from the base member 100 (as shown in FIG. 8).

Referring to FIG. 7A, in the erected form, the retail case 10 has length $L_{10}$ along a longitudinal x-axis, a width $W_{10}$ along a transverse y-axis, and a height $H_{10}$ along a vertical z-axis. Each of the length $L_{10}$, width $W_{10}$, and height $H_{10}$ of the retail case 10 are illustrated in FIG. 7A as constant dimensions. While each of these dimensions, are described and shown as being constant, one or more of these dimensions may vary across the retail case 10 without deviating from the design of this disclosure.

FIG. 7B illustrates an exploded view of the retail case 10 in its erected form. The attachment of the flap portions 246, 286 forms a divider 206 residing within the base member 100 near the bottom wall 108 of the retail case 10. Attachment of the flap portions 246, 286 to form the divider 206 may be accomplished by adhering a first surface of the flap portion 246, near its second end 246*b*, to a first surface of the flap portion 286, near its second end 286*b*. The first ends 246*a*, 286*a* of the flap portions 246, 286 remain connected to associated attachment portions 244, 284 at the inner surfaces 140*a*, 180*a* of the base walls 140, 180. The divider 206 aids in maintaining the position of any items or product disposed within the retail case 10 during shipping and storage of the items or product within the retail case 10. In alternative implementations of the disclosure, the divider 206 may be formed by a single flap portion, may be formed by more than two flap portions, or may be formed by a different mechanism than the specific flap portions 246, 286 illustrated in FIG. 7B. Accordingly, this disclosure encompasses various implementations of the divider 206 to accommodate differing items or product that may be disposed within the retail case 10 and to maintain their positioning within the retail case 10 during shipping and storage.

The attachment portions 244, 284 remain attached to the remainder of the upper walls 240, 280 at the predetermined areas of weakness 243, 245 (for attachment portion 244) and 283, 285 (for attachment portion 284; 283, 285 not labeled in FIG. 7B). Both attachment portions 244, 284 are also adhered to the inner surfaces 140*a*, 180*a* of the base walls 140, 180 of the base member 100. In alternative implementations of the disclosure, a single attachment portion or more than two attachment portions may be utilized to attach the base member 100 to the upper member 200. Also, the base member 100 may be attached to the upper member 200 utilizing a different attachment mechanism than the specific attachment portions 244, 284 illustrated in FIG. 7B.

In its erected form (as specifically shown in FIG. 7A), the retail case 10 substantially encloses any items of product that may be disposed within the retail case 10. Opposing walls have central holes 242, 282, which may serve different purposes. For example, the central holes 242, 282 may aid in the lifting and maneuvering of the retail case 10 when the upper member 200 is attached to the base member 100. The central holes 242, 282 may also provide a location at which a force is applied (see FIG. 8) to separate the attachment portions 244, 284 from the upper walls 240, 280 by tearing the tear-away lines 243*b*, 245*b*, 283*b*, 285*b* (shown in FIGS. 4A-4B). Separating the attachment portions 244, 284 from the upper walls 240, 280 allows the upper member 200 to be removed from the base member 100 while concurrently allowing a portion of the upper member 200 to remain with the base member 100. Namely, the attachment portions 244, 284 and, thus, the flap portions 246, 286 remain with the base member 100 when the upper member 200 is detached and removed from the base member 100. In short, a portion of the upper member 200 remains with the base member 100 when the upper member 200 is removed from the base member 100.

After shipping or storage of the retail case 10 with any items or product disposed within, the items or product may need to be displayed or dispensed. The retail case 10 may be used, as shown in FIG. 8, for the purpose of displaying or dispensing the items or product. Referring to FIG. 8, the upper member 200 of the retail case 10 may be removed from the base member 100 of the retail case 10. To do so, a force F may be applied to the central holes 242, 282 in a direction along the vertical z-axis away from the base member 100. The applied force tears the material forming the upper member 200 at the tear-away lines 243*b*, 245*b* to separate the attachment portion 244 from the second upper wall 240 and tears the material forming the upper member 200 at the tear-away lines 283*b*, 285*b* to separate the attachment portion 284 from the fourth upper wall 280. The attachment portion 244 remains adhered to the inner surface 140*a* of the second base wall 140, and the attachment portion 284 remains adhered to the inner surface 180*a* of the fourth base wall 180 when the upper member 200 is removed from the base member 100. Accordingly, the removal of the upper member 200 from the base member 100 does not affect the location of the divider 206 within the retail case 10. Further, the attachment portions 244, 284 and, thus, the flap portions 246, 286 remain attached to the base member 100 and, therefore, are attached to the base member 100 regardless of whether the upper member 200 is attached to the base member 100.

Upon removal of the upper member 200, the retail case consists only of the base member 100, which remains in its erected form, and the attachment portions 244, 284 with the associated flap portions 246, 286 that form the divider 206. In this manner, the divider 206 may continue to maintain the positioning of any items or product within the retail case 10 during their display. Accordingly, the divider 206 maintains a position of the product relative to the base member 100 even when some of the product is removed from the base member 100 and the retail case 10 is "shopped-down." In other words, when product is removed from the base member 10, the remaining product contained within the base member 10 does not fall down, as the divider 206 remains in contact with the product and keeps the product in a generally upright position. Such product positioning is advantageous, as signage or other markings associated with the product may be readily visible by shoppers even when some of the product originally contained within the retail case 10 is removed. The optional cut out 162 of the third base wall 160 also provides a better display of the items of products within the retail case 10. The upper member 200 may be discarded or utilized for a purpose unrelated to the ongoing functioning of the retail case 10.

Figure 9:
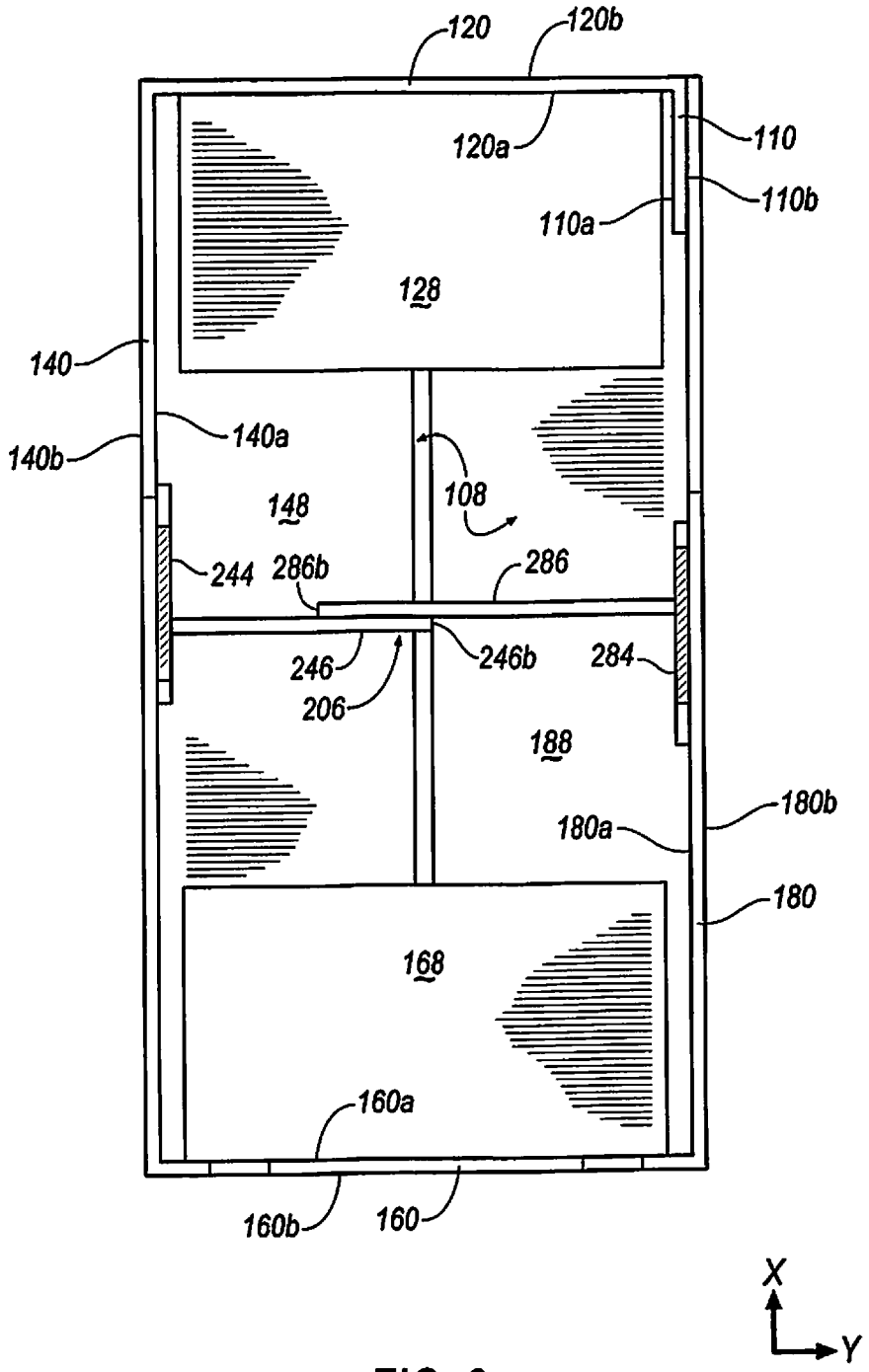
FIG. 9 is a top view of the base member of the retail case of FIG. 1 showing the upper member detached from the base member.

Referring to FIG. 9, after the removal of the upper member 200, the bottom wall 108 of the retail case 10, as formed by the bottom flaps 128, 148, 168, 188, remains intact in the erected state. Although, the upper-end flap 210 of the upper member 200 has been removed from the retail case 10, the base end flap 110 remains adhered, at its outer surface 110*b*, to the inner surface 180*a* of the fourth base wall 180. As previously described, prior to removal of the upper member 200, the base end flap 110 was not adhered to the upper member 200 and the fourth base wall 180 was not adhered to the upper-end flap 210. Accordingly, removal of the upper member 200 from the base member 100 does not affect the attachment of the base end flap 110 to the fourth base wall 180 and does not affect the positioning of the base walls 120, 140, 160, 180. The inner surfaces 120*a*, 140*a*, 160*a*, 180*a* of the base walls 120, 140, 160, 180 continue to cooperate with the bottom wall 108 to form the interior of the retail case 10.

The attachment portions 244, 284, which are no longer attached to the remainder of the upper member 200, remain adhered to the inner surface 140*a*, 180*a* of the respective base wall 140, 180. The flap portions 246, 286 extend into the interior of the retail case 10 and remain adhered near their second ends 246*b*, 286*b*, allowing the divider 206 to be unaffected by the removal of the upper member 200. Any items or product, such as an upright and/or soft-walled package, disposed within the interior of the retail case 10 that were supported by the divider 206 prior to the removal of the upper member 200 of the retail case 10 remain supported by the divider 206. Even after half of the items or product within the shopped-down retail case 10 have been purchased, the remaining items or product are kept upright in a displayed position by the divider 206. Visibility of the remaining items or product is enhanced because the divider 206 prevents the items or products from sliding down within the retail case 10 after some items or products have been purchased from the retail case 10. Due to the rigidity of the divider 206, the divider 206 may also stabilize the shopped-down retail case 10.

Referring generally to the disclosure, the retail case 10 may be formed by any one of a number of materials. For example, any type of corrugated cardboard or other paper-pulp-based material that permits the base member 100 and upper member 200 to be manufactured, connected, and erected as described in this disclosure may form the material of the retail case 10. Alternatively, non-paper-pulp-based materials that permit the base member 100 and upper member 200 to be manufactured, connected, and erected as described in this disclosure may form the material of the retail case 10.

Throughout the description of this disclosure, it is noted that different attachments are accomplished by adhering the surface of one part of the retail case 10 to the surface of another part. Each of these attachments may be accomplished using any type of adhesive product that allows the attachment of a surface of one part of a retail case 10 to a surface of a second part of a retail case 10.

Figure 10:
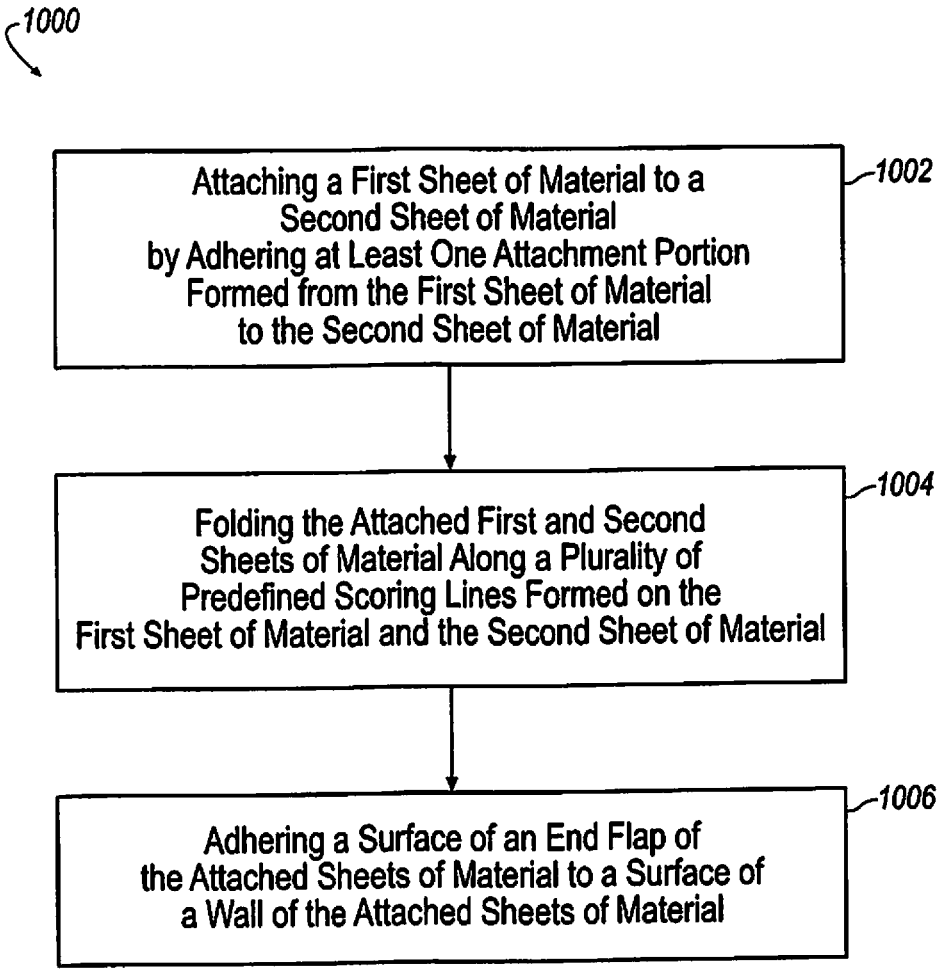
FIG. 10 is a flow chart detailing exemplary operations for constructing a retail case from a first sheet of material and a second sheet of material in accordance with the principles of the present disclosure.

FIG. 10 illustrates an exemplary arrangement of operations for a method 1000 for constructing a retail case 10 from a first sheet of material and a second sheet of material. At block 1002, the method 1000 includes attaching the first sheet of material to the second sheet of material. The first sheet of material may be the upper member 200 of the retail case 10 in its pre-erected form as illustrated in FIGS. 4A-4B. The second sheet of material may be the base member 100 of the retail case 10 in its pre-erected form as illustrated in FIGS. 2A-2B. The attachment of the first sheet of material to the second sheet of material is accomplished by adhering at least one attachment portion, for example two attachment portions 244, 284, from the first sheet of material to the second sheet of material. Either the first sheet of material, the second sheet of material, or both sheets of material include at least two walls and an end flap. For example, both sheets of material may include four walls 120, 140, 160, 180 (for the second sheet of material) and 220, 240, 260, 280 (for the first sheet of material) and an end flap 110 (for the second sheet of material) and 210 (for the first sheet of material). The attachment portion 244, 284 remains adhered to the second sheet of material when the first sheet of material detaches from the second sheet of material.

At block 1004, the method 1000 includes folding the attached first and second sheets of material along a plurality of predetermined scoring lines formed on the first sheet of material and the second sheet of material. For example, a first fold may occur between a first wall section 120, 220 and a second wall section 140, 240 along scoring line 130, 230. A second fold may occur between the second wall section 140, 240 and a third wall section 160, 260 along scoring line 150, 250. A third fold may occur between the third wall section 160, 260 and a fourth wall section 180, 280 along scoring line 170, 270. A fourth fold may occur along scoring line 111, 211 to fold the end flaps 110, 210. Additional folds may occur along scoring lines 129, 149, 169, 189 to form a bottom wall 108 from bottom flaps 128, 148, 168, 188 and along scoring lines 229, 249, 269, 289 to form a top wall 208 from top flaps 228, 248, 268, 288.

At block 1006, the method 1000 includes adhering a surface of the end flap to a surface of one of the at least two walls. For example, the outer surface 110*b* of the base-end flap 110 may adhere to the inner surface 180*a* of the fourth base wall 180. In addition, the outer surface 210*b* of the upper-end flap 210 may adhere to the inner surface 280*a* of the fourth upper wall 280.

To accomplish the method 1000, two attachment portions 244, 284 may embody the at least one attachment portion. Each of the two attachment portions 244, 284 may associate with a flap portion 246, 286 that is movable in relation to the associated attachment portion 244, 284. The method 1000 may further include attaching the flap portions 246, 286 to one another to form a divider 206 within the retail case 10. The flap portions 246, 286 may be attached to one another regardless of whether the first sheet of material is attached to the second sheet of material. The flap portions 246, 286 may also cooperate to extend across a width $W_{10}$ of the retail case 10. The flap portions 246, 286 may also extend substantially perpendicular to a longitudinal x-axis of the retail case 10.

Additionally, the at least one attachment portion may have a shape defined by a predetermined area of weakness in the first sheet of material. For example, if the at least one attachment portion is embodied by two attachment portions 244, 284, one attachment portion 244 may have a shape defined by weakness lines 243, 245 and the other attachment portion 284 may have a shape defined by other weakness lines 283, 285. The predetermined area of weakness may be defined by perforations formed in the first sheet of material. For example, portions of the predetermined areas of weakness 243, 245, 283, 285, such as the tear-away lines 243*b*, 245*b*, 283*b*, 285*b* and the perforations 245*c*, 285*c*, may be defined as perforations in the upper member 200. The at least one attachment portion may be separated from the first upper sheet of material along the perforations when the first sheet of material is removed from the second sheet of material. For example, when the upper member 200 is removed from the base member 100, as illustrated in FIG. 8, two attachment portions 244, 284 are separated from the upper member 200 when tear-away lines 243*b*, 245*b*, 283*b*, 285*b* of the predetermined areas of weakness 243, 245, 283, 285 are severed.

A number of implementations have been described. Nevertheless, it will be understood that various modifications may be made without departing from the spirit and scope of the disclosure. Accordingly, other implementations are within the scope of the following claims.

What is claimed is:

1. A retail case comprising:

a base member having a bottom wall, a first base wall, and a second base wall, the first and second base walls extending from said bottom wall, the first base wall having a first surface and a second surface, the second base wall having a third surface and a fourth surface, the first and third surfaces defining an outer surface of said base member, the second and fourth surfaces cooperating with said bottom wall to define an inner surface of said base member; and an upper member selectively attached to said base member and having a top wall, a first upper wall, and a second upper wall, the first and second upper walls extending from said top wall, said first upper wall including a fifth surface and a sixth surface, the second upper wall having a seventh surface and an eighth surface, the fifth and seventh surfaces defining an outer surface of said upper member, the sixth and eighth surfaces cooperating with said top wall to define an inner surface of said upper member, said first upper wall being attached at said fifth surface to said second surface of said first base wall at a first attachment portion of said first upper wall, said second upper wall being attached at said seventh surface to said fourth surface of said second base wall at a second attachment portion of said second upper wall, said first and second attachment portions being selectively removable from said first and second upper walls to allow said first and second attachment portions to remain attached to said base member when said upper member is removed from said base member, wherein said first attachment portion is coupled to a first flap portion formed from said first upper wall, and said second attachment portion is coupled to a second flap portion formed from said second upper wall, said first and second flap portions being movable relative to said base member when said upper member is removed from said base member, and wherein said first flap portion is attached to said second flap portion to connect said first upper wall to said second upper wall within said base member.

2. The retail case of claim 1, wherein said attachment portions are formed from said first and second upper walls and have a shape defined by predetermined areas of weakness.

3. The retail case of claim 2, wherein said predetermined areas of weakness are defined by perforations formed in said first and second upper walls.

4. The retail case of claim 3, wherein said attachment portions are separated from said first and second upper walls along said perforations when said upper member is removed from said base member.

5. The retail case of claim 1, wherein said outer surface of said upper member defines a first surface of said first flap portion and a second surface of said second flap portion, and wherein said first surface engages said second surface.

6. A retail case comprising:

a base member having a bottom wall, a first base wall, and a second base wall, the first and second base walls extending from said bottom wall, said first base wall having a first surface and a second surface, the second base wall having a third surface and a fourth surface, the first and third surfaces defining an outer surface of said base member, the second and fourth surfaces cooperating with said bottom wall to define an inner surface of said base member; and an upper member selectively attached to said base member and having a top wall, a first upper wall, and a second upper wall, the first and second upper walls extending from said top wall, said first upper wall including a fifth surface and a sixth surface, the second upper wall having a seventh surface and an eighth surface, the fifth and seventh surfaces defining an outer surface of said upper member, the sixth and eighth surfaces cooperating with said top wall to define an inner surface of said upper member, said first upper wall having a first flap portion formed from said first upper wall, said second upper wall having a second flap portion formed from said second upper wall, said first and second flap portions attached to said base member when said upper member is removed from said base member, said first and second flap portions being movable relative to said base member when said upper member is removed from said base member, wherein at least one of said first or second flap portions extends across a portion of said base member such that said first flap portion engages said second flap portion.

7. The retail case of claim 6, wherein said flap portions are attached to one another to connect said first upper wall to said second upper wall within said base member.

8. The retail case of claim 6, wherein said first flap portion has a shape defined by a predetermined area of weakness formed in said first upper wall.

9. The retail case of claim 8, wherein said predetermined area of weakness is defined by perforations formed in said first upper wall.

10. The retail case of claim 9, wherein said first flap portion is separated from said first upper wall along said perforations when said upper member is removed from said base member.

11. The retail case of claim 6, wherein said base member includes a third base wall and a fourth base wall, wherein said upper member includes a third upper wall and a fourth upper wall, and wherein said first upper wall opposes said second upper wall.

12. The retail case of claim 6, wherein said outer surface of said upper member defines a first surface of said first flap portion and a second surface of said second flap portion, and wherein said first surface engages said second surface.

13. A method for constructing a retail case from a first sheet of material and a second sheet of material, the method comprising:

attaching the first sheet of material to the second sheet of material, at least one of the first sheet of material and the second sheet of material comprising at least two walls and an end flap, wherein attaching the first sheet of material to the second sheet of material includes adhering a first attachment portion and a second attachment portion formed from the first sheet of material to the second sheet of material, and wherein said first attachment portion and said second attachment portion remains adhered to the second sheet of material when the first sheet of material detaches from the second sheet of material;

folding said attachment of the first and second sheets of material along a plurality of predefined scoring lines formed on the first sheet of material and the second sheet of material;

adhering a surface of said end flap to a surface of one of said at least two walls; and adhering a first flap portion of said first attachment portion to a second flap portion of said second attachment portion.

14. The method of claim 13, wherein said first flap portion is movable relative to said first attachment portion; and wherein said flap portions form a divider within the retail case.

15. The method of claim 14, wherein said flap portions cooperate to extend across a width of the retail case.

16. The method of claim 14, wherein said flap portions extend substantially perpendicular to a longitudinal axis of the retail case.

17. The method of claim 13, wherein said attachment portions has a shape defined by a predetermined area of weakness formed in the first sheet of material.

18. The method of claim 17, wherein said predetermined area of weakness is defined by perforations formed in the first sheet of material.

19. The method of claim 18, wherein said attachment portions is separated from the first sheet of material along said perforations when the first sheet of material is removed from the second sheet of material. said first surface engages said second surface.

20. The method of claim 13, wherein an outer surface of said first sheet of material defines a first surface of said first flap portion and a second surface of said second flap portion, and wherein adhering said first flap portion to said second flap portion includes adhering said first surface to said second surface.

* * * * *